US011605351B2

(12) United States Patent
Gao et al.

(10) Patent No.: US 11,605,351 B2
(45) Date of Patent: Mar. 14, 2023

(54) DISPLAY PANEL HAVING A COMPENSATION UNIT FOR LEAKAGE CURRENT, DRIVING METHOD THEREOF AND DISPLAY DEVICE

(71) Applicants: WUHAN TIANMA MICROELECTRONICS CO., LTD., Wuhan (CN); WUHAN TIANMA MICROELECTRONICS CO., LTD. SHANGHAI BRANCH, Shanghai (CN)

(72) Inventors: Yana Gao, Shanghai (CN); Xingyao Zhou, Shanghai (CN); Mengmeng Zhang, Shanghai (CN); Shuai Yang, Shanghai (CN)

(73) Assignee: Shanghai Tianma AM-OLED Co., Ltd., Shanghai (CN)

( * ) Notice: Subject to any disclaimer, the term of this patent is extended or adjusted under 35 U.S.C. 154(b) by 0 days.

(21) Appl. No.: 17/405,111

(22) Filed: Aug. 18, 2021

(65) Prior Publication Data

US 2021/0375213 A1 Dec. 2, 2021

(30) Foreign Application Priority Data

Dec. 31, 2020 (CN) ..... 202011627013.3

(51) Int. Cl.
*G09G 3/3266* (2016.01)
*G09G 3/3258* (2016.01)
*G09G 3/3291* (2016.01)

(52) U.S. Cl.
CPC ..... *G09G 3/3266* (2013.01); *G09G 3/3258* (2013.01); *G09G 3/3291* (2013.01);
(Continued)

(58) Field of Classification Search
CPC ..... G09G 3/3266
(Continued)

(56) References Cited

U.S. PATENT DOCUMENTS

2010/0277400 A1* 11/2010 Jeong ..... G09G 3/3275 345/76
2019/0206502 A1* 7/2019 Lim ..... G09G 3/20
(Continued)

FOREIGN PATENT DOCUMENTS

CN 102737581 A 10/2012
CN 107871474 A 4/2018
(Continued)

OTHER PUBLICATIONS

Chinese Office Action related to Application No. 202011627013.3 dated Nov. 18, 2021.

*Primary Examiner* — Long D Pham
(74) *Attorney, Agent, or Firm* — von Briesen & Roper, s.c.

(57) ABSTRACT

Disclosed are a display panel and a display device. The display panel includes a display area and a non-display area surrounding the display area. The display area includes scan lines arranged in a second direction and each extending in a first direction, data lines arranged in the first direction and each extending in the second direction, and pixel driver circuits defined by the scan lines and the data lines intersecting each other, the first direction intersecting the second direction. The non-display area includes a step area and a compensation unit, and the compensation unit is located between the step area and a last row of pixel driver circuits. The compensation unit is connected to a corresponding data line and configured to transmit a leakage current compensation signal to the data line.

15 Claims, 15 Drawing Sheets

(52) U.S. Cl.
CPC ..... *G09G 2300/043* (2013.01); *G09G 2300/0413* (2013.01); *G09G 2320/0204* (2013.01)

(58) Field of Classification Search
USPC ..... 345/55
See application file for complete search history.

(56) References Cited

U.S. PATENT DOCUMENTS

| | | | | |
|---|---|---|---|---|
| 2020/0105197 | A1* | 4/2020 | Yin | G09G 3/3258 |
| 2021/0201760 | A1* | 7/2021 | Wang | G09G 3/3233 |

FOREIGN PATENT DOCUMENTS

| | | | |
|---|---|---|---|
| CN | 106206619 | B | 10/2019 |
| CN | 111862890 | A | 10/2020 |

* cited by examiner

DISPLAY PANEL HAVING A COMPENSATION UNIT FOR LEAKAGE CURRENT, DRIVING METHOD THEREOF AND DISPLAY DEVICE

CROSS-REFERENCE TO RELATED APPLICATION

This application claims priority to Chinese Patent Application No. 202011627013.3 filed Dec. 31, 2020, the disclosure of which is incorporated herein by reference in its entirety.

TECHNICAL FIELD

The present disclosure relates to the field of display technologies and, in particular, to a display panel, a method for driving a display panel, and a display device.

BACKGROUND

More and more wearable apparatus employ organic light-emitting diode (OLED) display panels as display technologies develop. Wearable apparatus such as a watch have low requirements for display effect, however, they require high power consumption. Therefore, it is anew development direction to reduce a refresh rate and the power consumption of the display panel. However, the OLED display panel is driven by current, and a drive current generated by a pixel driver circuit is determined by a voltage difference between a source electrode and a gate electrode of a drive transistor. The source electrode of the drive transistor receives a power supply voltage, and the gate electrode of the drive transistor receives a data signal voltage and stores the data signal voltage in a storage capacitor. Under a low-frequency driving, the time of one frame is prolonged, and due to a fact that a channel leakage current and a film layer leakage current exist, the data signal voltage stored at the gate electrode of the drive transistor is changed and the brightness jumps accordingly, resulting in a phenomenon of flicker.

SUMMARY

It is desirable to provide a display panel and a display device which can solve a technical problem existing in the related art.

In one aspect, the present application provides a display panel. The display panel includes a display area and a non-display area surrounding the display area. The display area includes scan lines arranged in a second direction and each extending in a first direction, data lines arranged in the first direction and each extending in the second direction, and pixel driver circuits defined by the scan lines and the data lines intersecting each other, where the first direction intersect the second direction. The non-display area includes a step area and a compensation unit, and the compensation unit is located between the step area and a last row of pixel driver circuits. The compensation unit is connected to a corresponding data line and configured to transmit a leakage current compensation signal to the data line.

In another aspect, the present application discloses a method for driving a display panel. When the display panel is in a first frequency mode, the method for driving the display panel includes a refresh phase and a hold phase. A drive frequency of the first frequency mode is less than or equal to 30 Hz. In the refresh phase, a data signal is written into the drive transistor, and at the end of the refresh phase, a current compensation signal is written into a corresponding data line.

In still another aspect, the present application provides a display device including the display panel described above.

According to the display panel and the display device provided in the present application, a leakage current may be compensated, and a phenomenon that the display panel flickers under a low-frequency driving is prevented.

BRIEF DESCRIPTION OF DRAWINGS

Features, objects, and advantages of the present application will become more apparent from a reading of the detailed description of non-limiting embodiments made with reference to following drawings.

DETAILED DESCRIPTION

Figure 1:
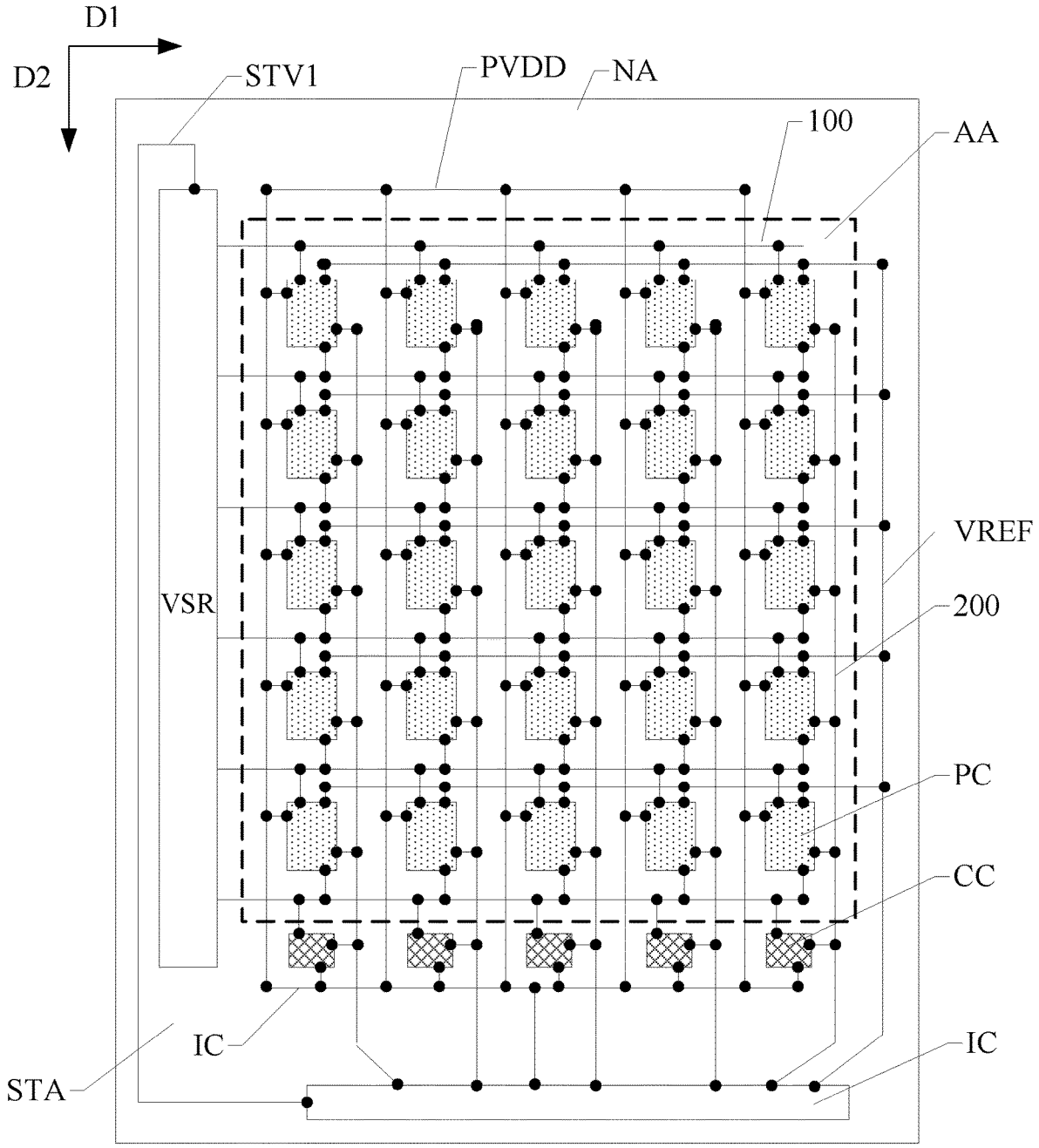
FIG. 1 shows a schematic diagram of a display panel in an embodiment of the present application.

The present application is detailed below according to embodiments in conjunction with the accompanying drawings. It is understood that specific embodiments described herein are merely intended to illustrate the relevant disclosure, rather than to limit the present disclosure. It is noted that, for ease of description, only parts related to the present disclosure are shown in the drawings.

It is noted that embodiments of the present application and the features of the embodiments may be combined with each other in case of no conflict. The present application will be described in detail below with reference to the accompanying drawings in combination with embodiments.

A wearable apparatus such as a watch has low requirement for the display effect, however, requires for low power consumption. In order to reduce the power consumption, products such as the watch usually adopt a low-frequency driving manner; however, unlike a low-frequency driving of a liquid crystal display panel, a low-frequency driving of the OLED display panel has a flicker problem. It is found that the OLED display panel is driven by a current, and a drive current generated by a pixel driver circuit depends on a voltage difference between a source electrode and a gate electrode of a drive transistor, Vgs. The source electrode of the drive transistor receives a power supply voltage, and the gate electrode of the drive transistor receives a data signal voltage and stores the data signal voltage in a storage capacitor. The power supply voltage is an active signal, and the data signal voltage is stored in the storage capacitor. However, due to a fact that a channel leakage current and a film layer leakage current exist, the data signal voltage stored at the gate electrode of the drive transistor is changed, so that a potential Vg of the gate electrode of the drive transistor is changed, and the Vgs is changed, and further, the brightness jumps accordingly, resulting in a phenomenon of flicker. Under a normal driving mode, such as under a driving frequency of 60 Hz, the time of one frame is 16.67 ms; during the time of one frame, change in the potential at the gate electrode (node N1) of the drive transistor is relatively small, so change in the brightness is relatively small and may not be easily identified by human eyes. However, when the driving frequency turns to 30 Hz, the time of one frame is changed into 33.33 ms, the potential at the node N1 drops a lot, and meanwhile since the frequency is reduced, flicker can be observed by human eyes. Further, the time of one frame under the driving frequency of 15 Hz is changed into 66.67 ms, the potential at the node N1 drops more, and meanwhile the frequency is reduced more, so that flicker can be obviously observed by human eyes. Therefore, low-frequency driving is unavailable, impeding the reduction of the power consumption of the OLED display panel.

Figure 2:
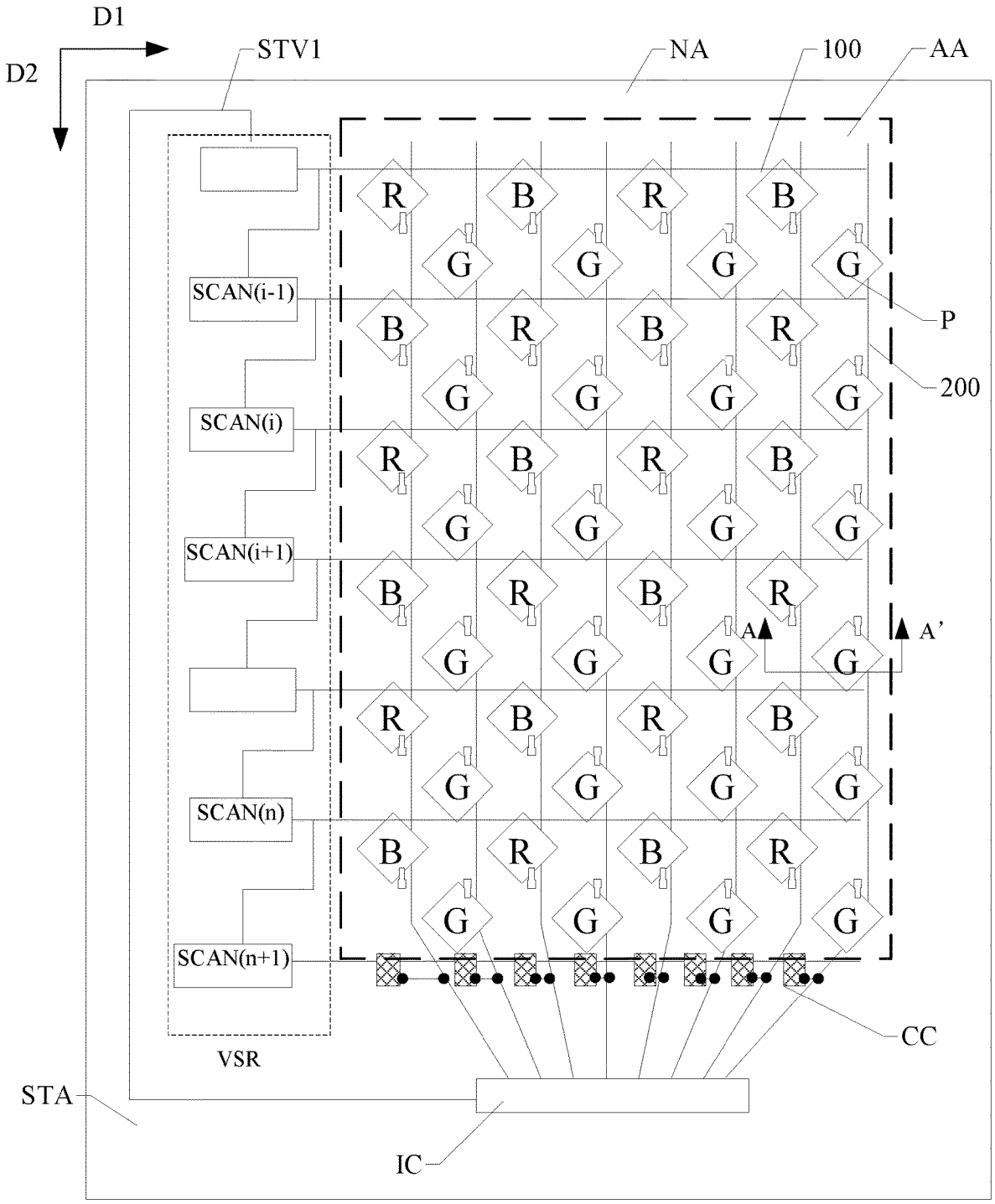
FIG. 2 shows a schematic diagram of a display panel in another embodiment of the present application.
Figure 3:
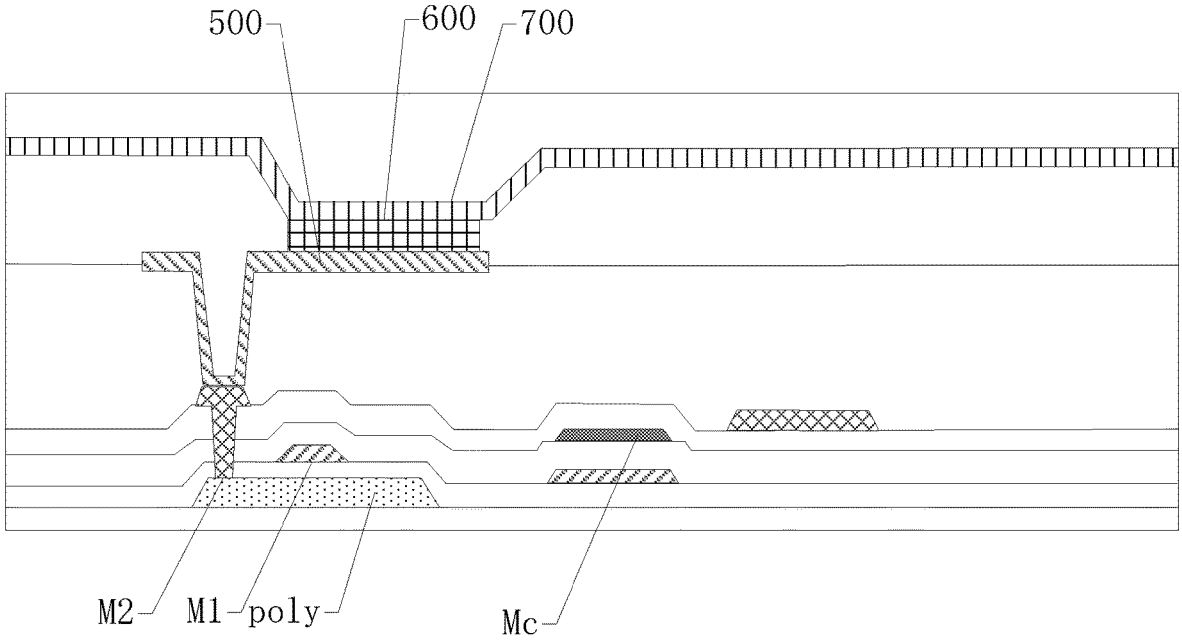
FIG. 3 shows a schematic cross-sectional view taken along AA' of FIG. 2.
Figure 4:
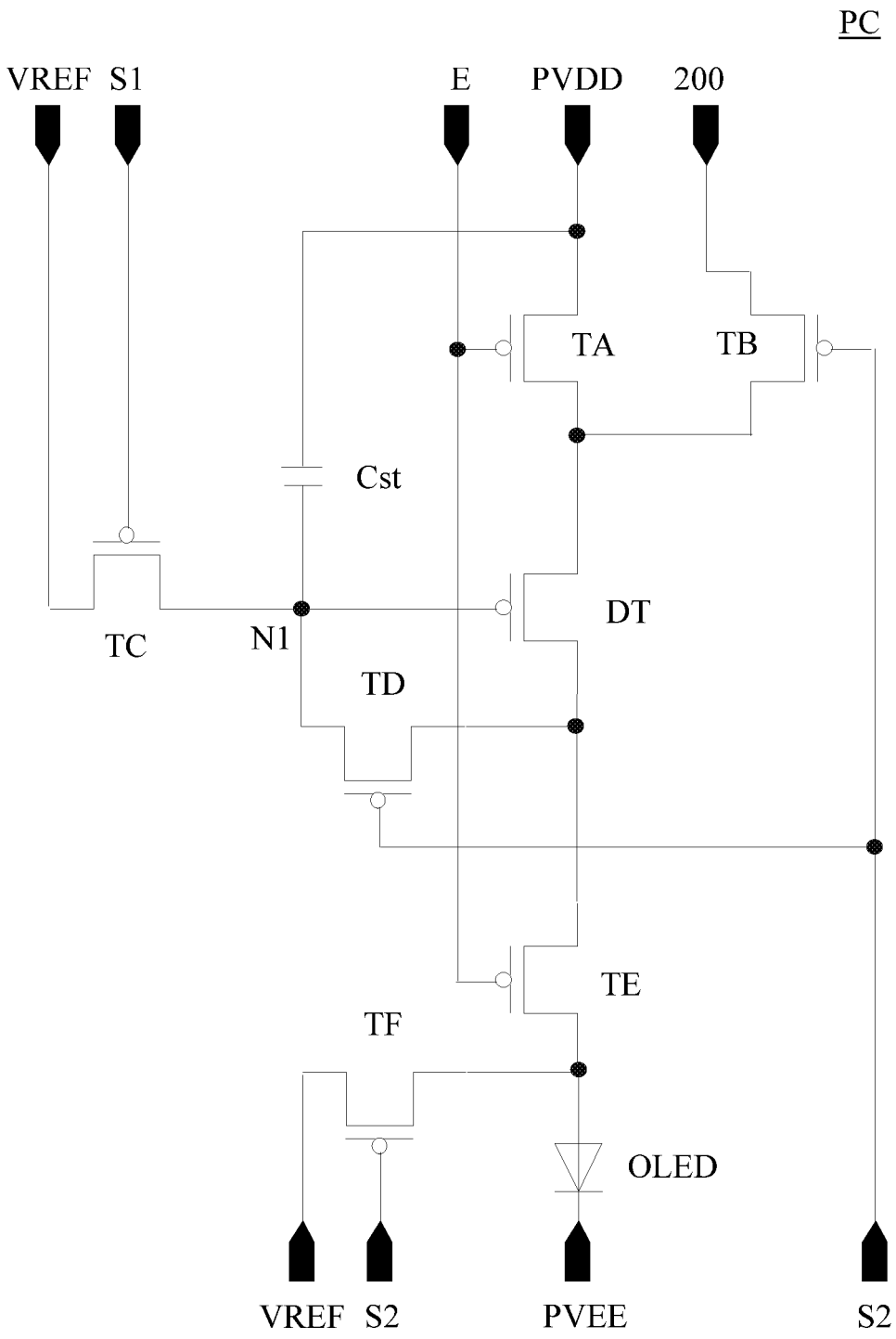
FIG. 4 shows a schematic diagram of an equivalent circuit of a pixel driver circuit in an embodiment of the present application.
Figure 5:
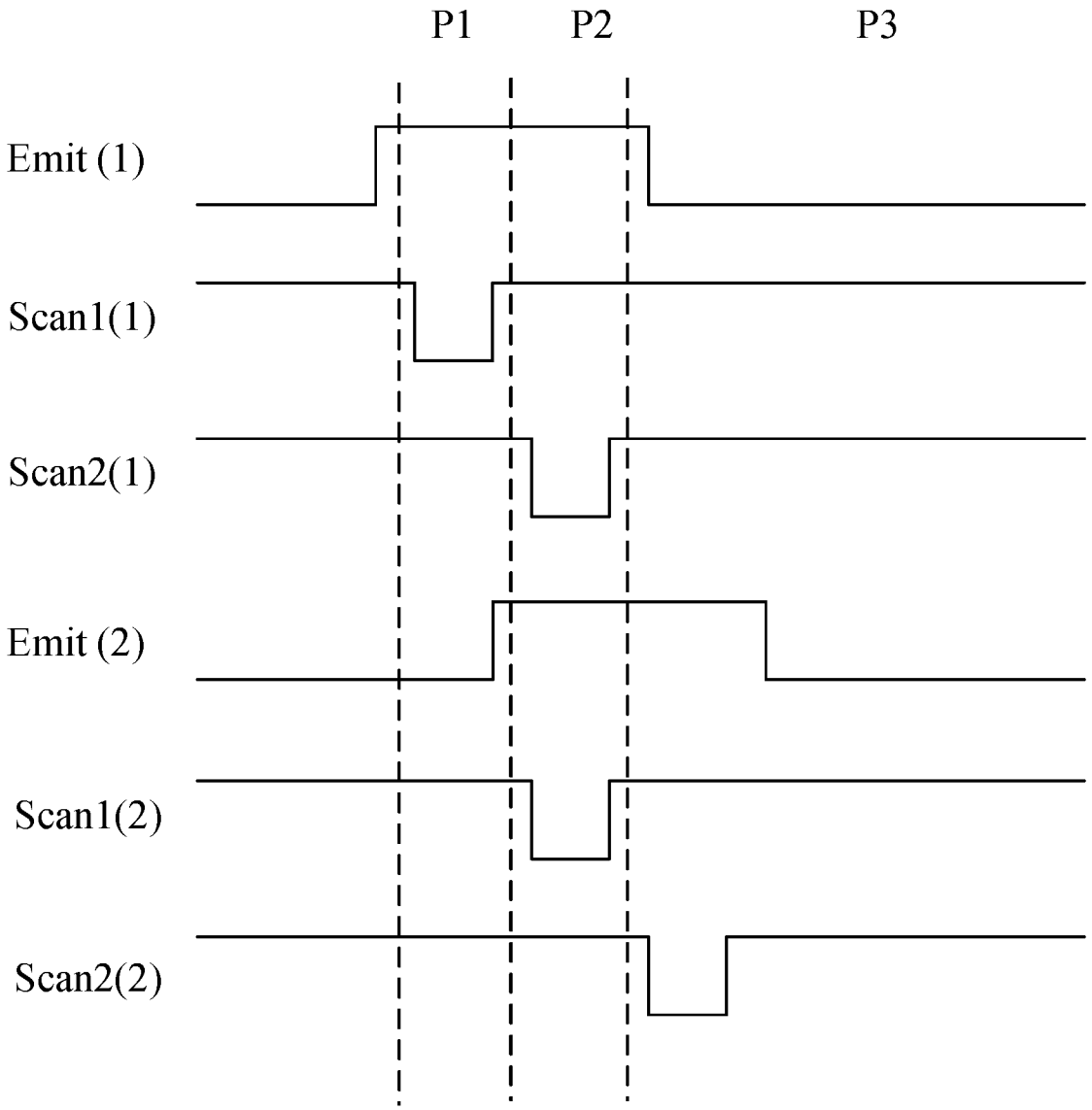
FIG. 5 shows a schematic timing diagram of the pixel driver circuit in FIG. 4.
Figure 6:
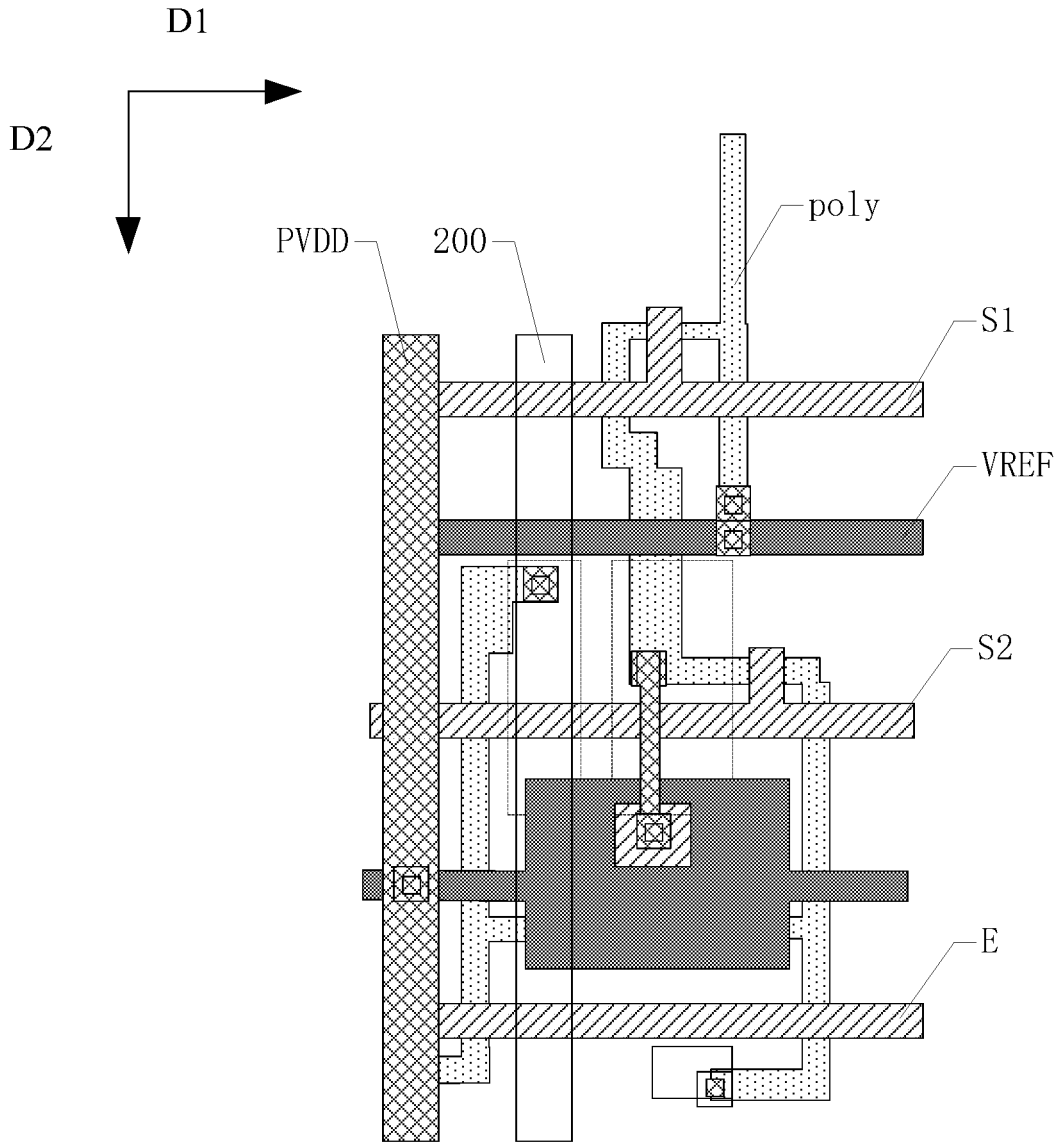
FIG. 6 shows a schematic layout diagram of the pixel driver circuit in FIG. 4.
Figure 7:
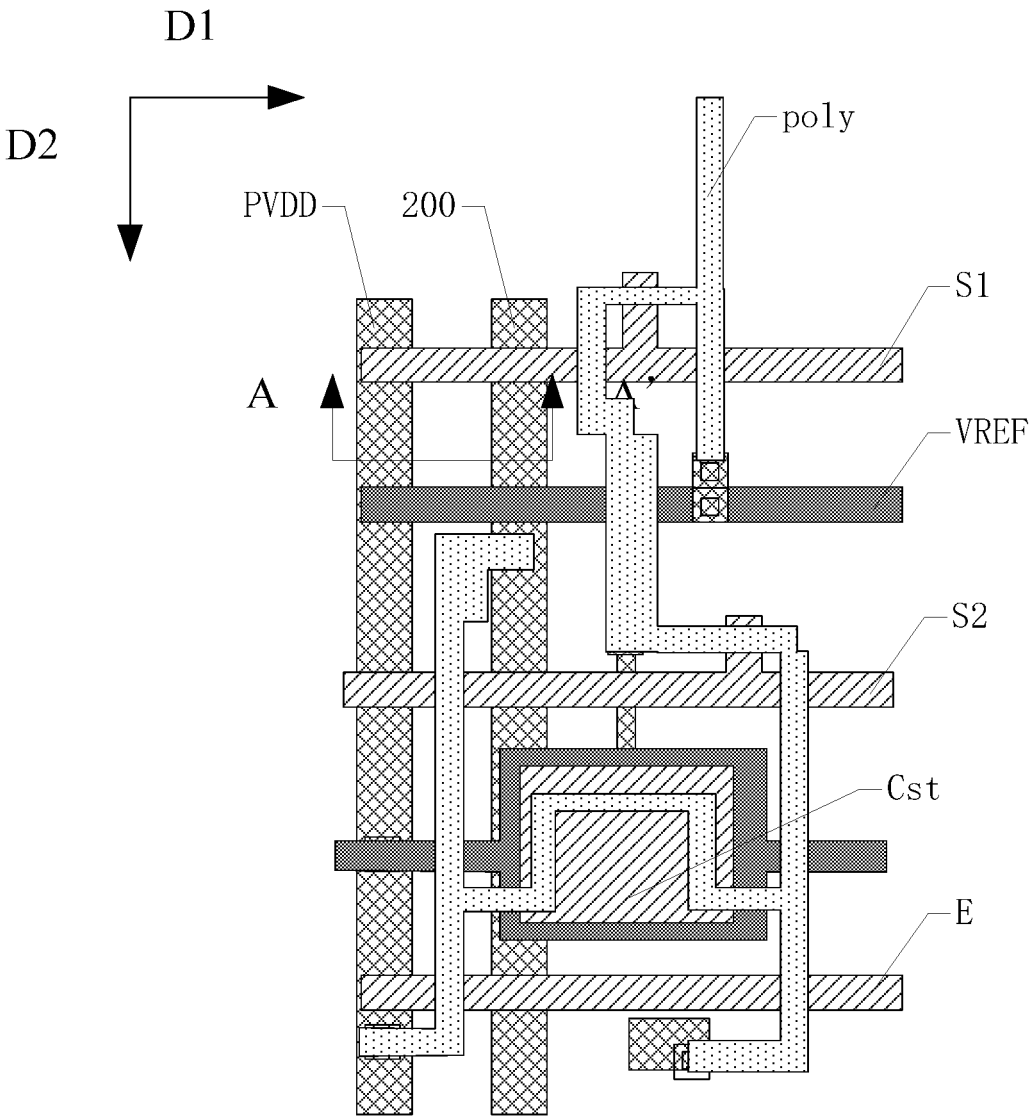
FIG. 7 shows a schematic diagram of the layout in FIG. 6 observed from another side.
Figure 8:
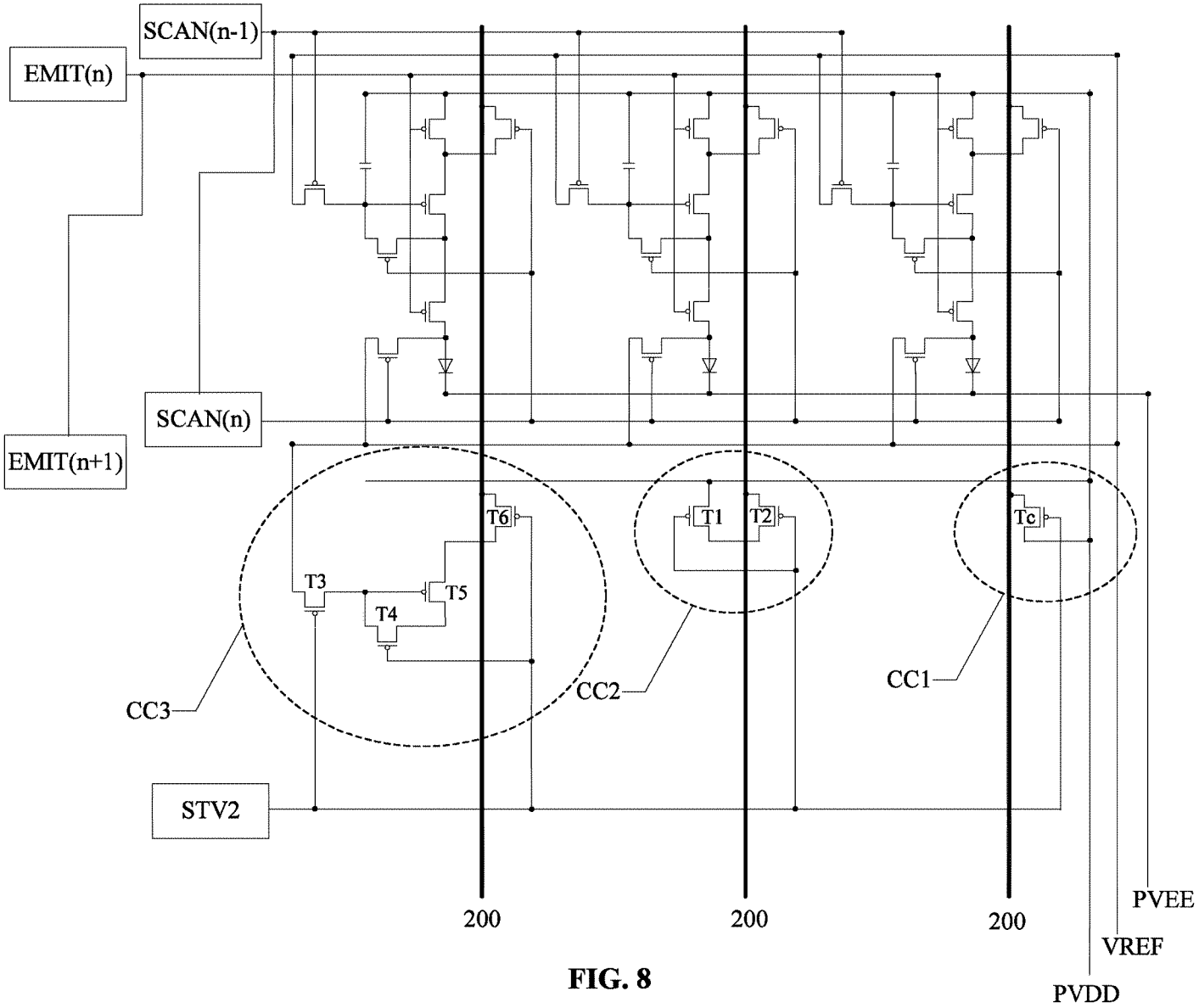
FIG. 8 shows a schematic diagram of a display panel according to an embodiment of the present disclosure.

The present application provides a display panel which can reversely compensate for a leakage current, relieve the brightness jump, and prevent the display panel from flickering. Reference may be made to FIGS. 1 to 8. FIG. 1 shows a schematic diagram of a display panel according to an embodiment of the present application; FIG. 2 shows a schematic diagram of a display panel in another embodiment of the present application; FIG. 3 shows a schematic cross-sectional view taken along AN of FIG. 2; FIG. 4 shows a schematic diagram of an equivalent circuit of a pixel driver circuit according to an embodiment of the present application; FIG. 5 shows a schematic timing diagram of the pixel driver circuit in FIG. 4; FIG. 6 shows a schematic layout diagram of the pixel driver circuit in FIG. 4; FIG. 7 shows a schematic diagram of the layout in FIG. 6 observed from another side; and FIG. 8 shows a schematic diagram of a display panel according to an embodiment of the present disclosure.

In an embodiment of the present application, the display panel includes a display area AA and a non-display area NA surrounding the display area. The display area AA includes: scan lines 100 arranged in a second direction D2 and each extending in a first direction D1; data lines 200 arranged in the first direction D1 and each extending in the second direction D2; and pixel driver circuits PCs defined by the scan lines 100 and the data lines 200 intersecting with each other. The first direction D1 and the second direction D2 intersect; for example, the first direction D1 may be perpendicular to the second direction D2. Optionally, referring to FIGS. 4 and 5, the pixel driver circuit PC of the present application may include a drive transistor DT, a data write transistor TB, a light-emitting control transistor TA, a gate electrode initialization transistor TC, and a threshold compensation transistor TD. The light-emitting control transistor TA, the drive transistor DT and a light-emitting element OLED are connected in series between a first power supply voltage end PVDD and a second power supply voltage end PVEE. The threshold compensation transistor TD is connected between a gate electrode and a second electrode of the drive transistor DT. The gate electrode initialization transistor TC is connected to the gate electrode of the drive transistor DT. The data write transistor TB is connected between the data line 200 and a first electrode of the drive transistor DT. The pixel driver circuit PC may further include a second light-emitting control transistor TE and a light-emitting element initialization transistor TF. The second light-emitting control transistor TE is connected between the drive transistor DT and the light-emitting element OLED, and the light-emitting element initialization transistor TF is connected to the light-emitting element for initialization of the light-emitting element.

Exemplarily, referring to FIGS. 4 and 5, the gate electrode initialization transistor is connected to a first scan signal terminal SI; the data write transistor TB, the threshold compensation transistor TD and the light-emitting element initialization transistor TF are connected to a second scan signal terminal S2; and the light-emitting control transistor TA and the second light-emitting control transistor TE are connected to a light-emitting control signal terminal E. A working process of the pixel driver circuit includes an initialization phase P1, a threshold compensation phase P2 and a light-emitting phase P3.

These three phases are described below by using a pixel driver circuit located in a first row as an example. The light-emitting control signal terminal of the pixel driver circuit located in the first row receives a light-emitting control signal Emit (1), the first scan signal terminal of the pixel driver circuit located in the first row receives a first scan signal Scan1 (1), and the second scan signal terminal of the pixel driver circuit located in the first row receives a second scan signal Scan2 (1).

In the initialization phase P1, the light-emitting control signal Emit (1) is at a high level, the first scan signal Scan1 (1) is at a low level, and the second scan signal Scan2 (1) is at a high level; the gate electrode initialization transistor TC is switched on, and an initialization signal Vref from an initialization signal terminal VREF is transmitted to the gate electrode of the drive transistor DT, so that the gate electrode of the drive transistor is reset.

In the threshold compensation phase P2, the light-emitting control signal Emit (1) is at a high level, the first scan signal Scan1 (1) is at a high level, and the second scan signal Scan2 (1) is at a low level; the light-emitting element initialization transistor TF is switched on, and the initialization signal Vref from the initialization signal terminal VREF is transmitted to the light-emitting element, so that the light-emitting element is reset; moreover, the data write transistor TB and the threshold compensation transistor TD are switched on, a data signal DaTa is transmitted to the gate electrode of the drive transistor DT through the drive transistor DT and the threshold compensation transistor TD, when a potential difference between the gate electrode and the first electrode of the drive transistor DT is a threshold of the drive transistor DT, the drive transistor DT is turned off, and at this time, a potential of the gate electrode of the drive transistor is VdaTa−|Vth|.

In the light-emitting phase P3, the light-emitting control signal Emit (1) is at a low level, the first scan signal Scan1 (1) is at a high level, and the second scan signal Scan2 (1) is at a high level; the light-emitting control transistor TA and the second light-emitting control transistor TE are switched on, the first power supply voltage end PVDD transmits a first power supply signal Pvdd to the first electrode of the drive transistor DT, and the drive transistor DT generates a drive current which flows through the light-emitting element OLED so as to drive the light-emitting element OLED to emit light. A magnitude of the drive current generated by the drive transistor DT is $Ids=k*(Vgs-Vth)^2=k*(VdaTa-|Vth|-Pvdd-Vth)^2=k*(Pvdd-VdaTa)^2$. Therefore, the uneven brightness caused by uneven threshold voltage Vth and drift of the drive transistor is eliminated.

However, in the light-emitting phase P3, the potential of the gate electrode of the drive transistor DT leaks electricity to the initialization signal terminal VREF through the gate electrode initialization transistor TC, and leaks electricity to the second electrode of the drive transistor DT through the threshold compensation transistor TD, so that a voltage of the gate electrode of the drive transistor DT is changed, and further, the drive current is changed and thus the brightness of the light-emitting element is deviated from a target brightness.

On the other hand, referring to FIGS. 6 and 7, which are a layout of the pixel driver circuit shown in FIG. 4. An area where an active layer poly and the scan line are overlapped is provided with a transistor. For example, a gate electrode initialization transistor TC for a current row and a light-emitting element initialization transistor TF for a previous row are formed in an area where a first scan signal line S1 overlaps the active layer poly.

Referring to the layout in FIGS. 6 and 7 and the film layer structure diagram in FIG. 3, the initialization signal line VREF transmits the initialization signal Vref, the first scan signal line S1 transmits a scan signal Scan1, and the second scan signal line S2 transmits a second scan signal Scan2; the light-emitting signal line E provides a light-emitting control signal Emit; a first power supply signal line PVDD transmits a power supply signal Pvdd, and a transverse power supply signal line 120 is connected to a power supply signal line 210 through a via hole, transmits the power supply signal Pvdd, and serves as an electrode of a storage capacitor. Referring to FIG. 6, a semiconductor layer in the pixel driver circuit includes the active layer poly; the first scan signal line S1, the second scan signal line S2 and a light-emitting control signal line E are located at a gate electrode metal layer M1 and serve as a gate electrode of the transistor; in addition, one electrode of the storage capacitor Cst is located at the gate electrode metal layer M1. The initialization signal line VREF and another electrode of the storage capacitor Cst are located at a capacitor metal layer Mc. The power supply signal line PVDD and the data line 200 are located at a source-drain metal layer M2. At the same time, a pixel P includes the light-emitting element, the light-emitting element includes an anode 500, a cathode 700, and an organic light-emitting material 600 located between the cathode and the anode. The anode 500 is connected to a drain electrode M2 of the transistor through a via hole.

During low-frequency driving, the potential at the gate electrode, node N1, of the drive transistor DT needs to be kept for a long time, and the leakage current causes the potential of the node N1 to change continuously, for example, the potential of the node N1 is continuously pulled down by the Vref due to electric leakage of the TC transistor, so that a light-emitting current Ids is continuously increased, and the brightness is increased. Or, the potential of the node N1 is pulled down through electric leakage between film layers, and after the data signal voltage is written in a next frame, the brightness is rapidly decreased, so that a phenomenon of flicker is observed by human eyes.

With continued reference to FIGS. 1 and 2, in the present application, the non-display area NA includes a step area STA and a compensation unit CC; the compensation unit CC is located between the step area STA and a last row of pixel driver circuits PC; and the compensation unit CC is connected to a corresponding data line 200 for transmitting a leakage current compensation signal to the data line 200.

In the present application, the current compensation signal is transmitted to the data line 200 by the compensation unit CC, and the current compensation signal reversely compensates a leakage current of the node N1, so that a technical problem of screen shaking is avoided. For example, when an overall brightness of the display panel drops, the compensation unit CC supplies a low potential to the data line 200, and increases a leakage current of the node N1 to the low potential, so that the overall brightness is raised, and the leakage current of the node N1 is reversely compensated. Similarly, when the overall brightness of the display panel is increased, the compensation unit CC provides a high potential to the data line 200, and increases a leakage current of the node N1 to the high potential, so that the overall brightness is decreased, and the leakage current of the node N1 is reversely compensated.

Figure 9:
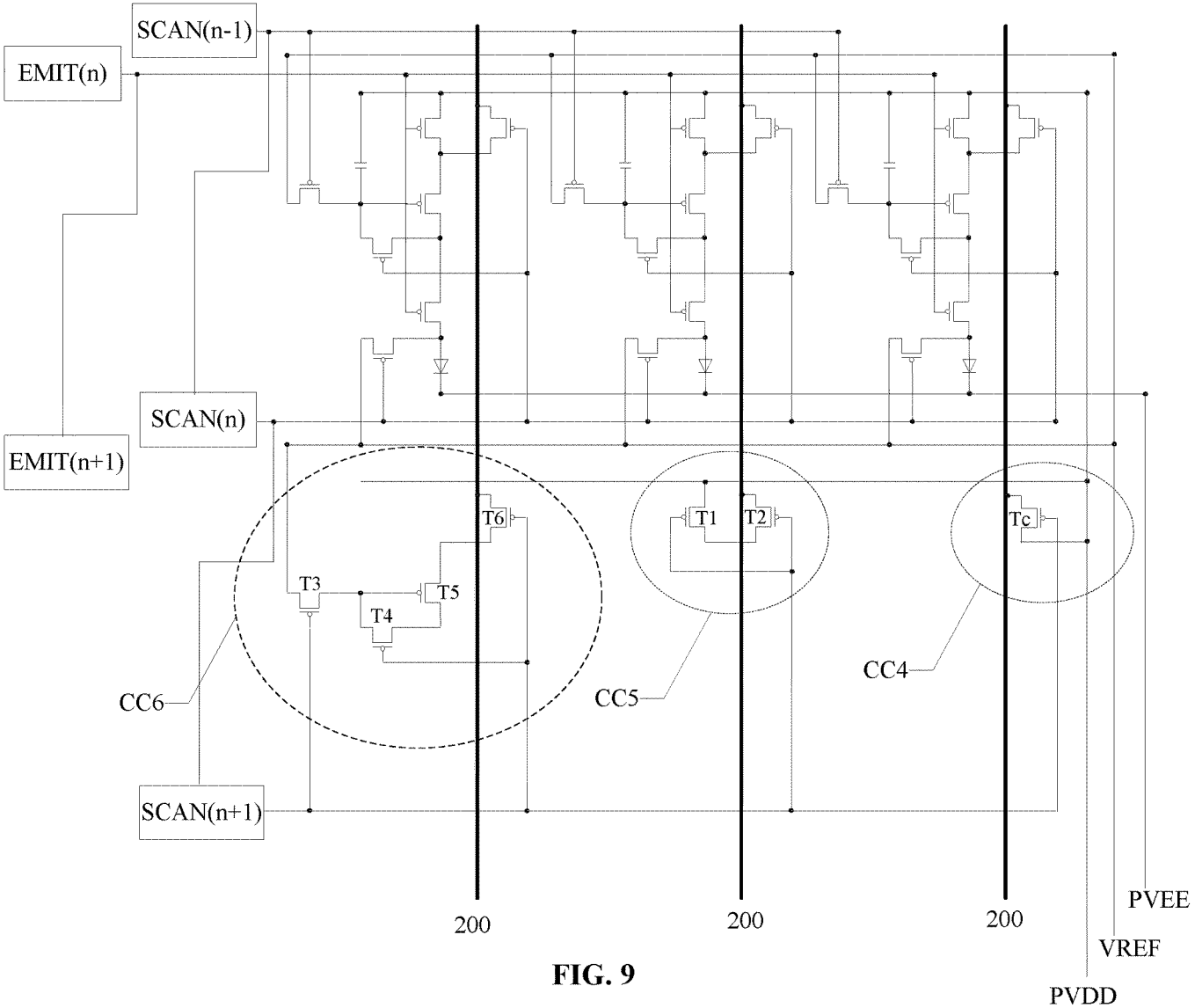
FIG. 9 shows a schematic diagram of a display panel according to another embodiment of the present application.
Figure 10:
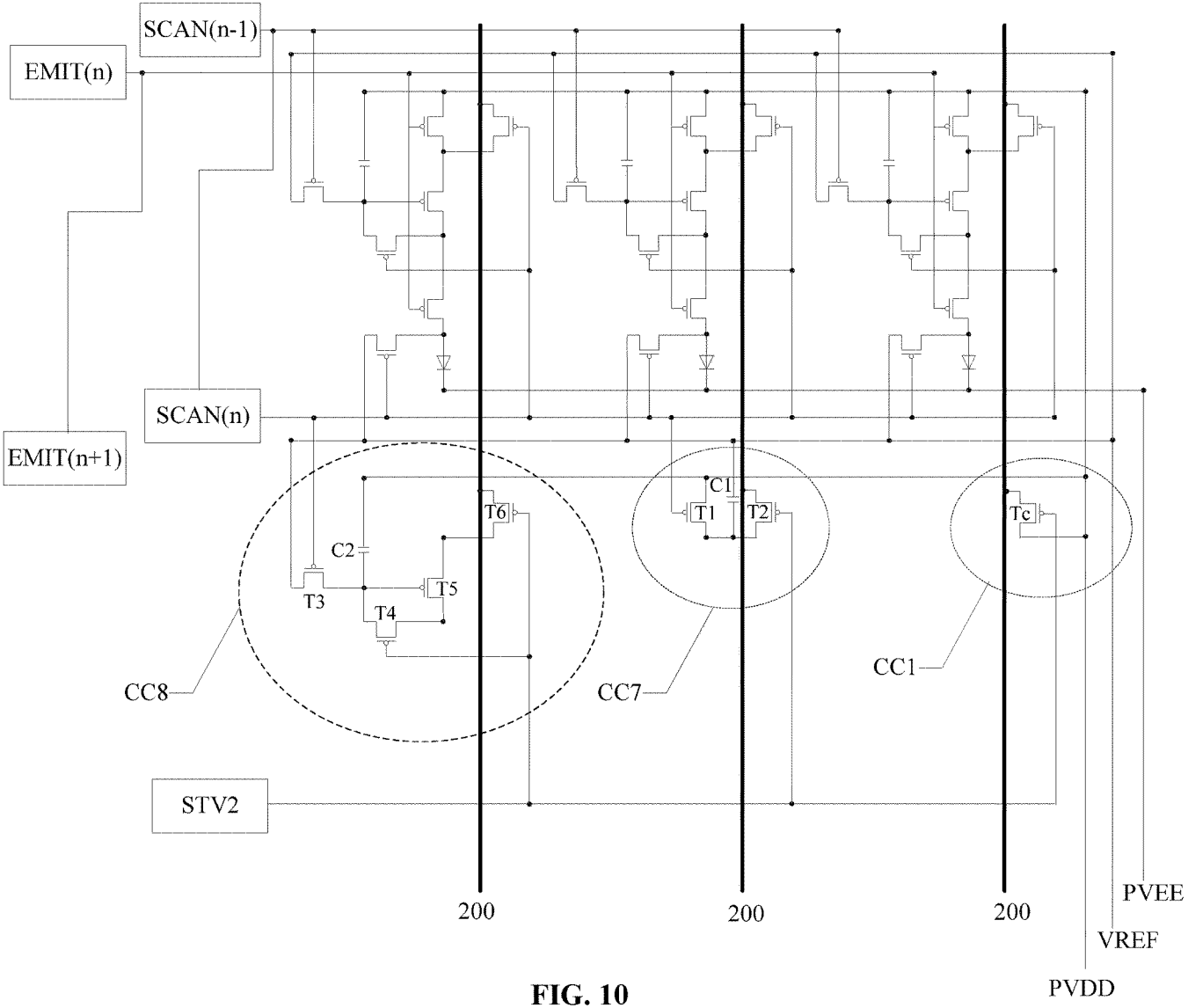
FIG. 10 shows a schematic diagram of a display panel according to still another embodiment of the present application.

Referring to FIGS. 8, 9, and 10, FIG. 8 shows a schematic diagram of a display panel according to an embodiment of the present disclosure; FIG. 9 shows a schematic diagram of a display panel according to another embodiment of the present application; and FIG. 10 shows a schematic diagram of a display panel according to still another embodiment of the present application.

In the embodiments, the display panel of the present application includes a scan driver circuit VSR; the scan driver circuit includes cascaded scan driver circuit units SCAN (1)~SCAN (n); an $i_{th}$ row of scan line is connected to an $i_{th}$ stage scan driver circuit unit SCAN (i); an $n_{th}$ stage scan driver circuit unit SCAN (n) is connected to a last row of scan line; an input terminal of a first stage scan driver circuit unit SCAN (1) is connected to a first initial signal line STV1, where $1 \le i \le n$, and i and n are positive integers.

In an embodiment of the present application, the compensation unit CC includes a compensation transistor Tc, where a first electrode of the compensation transistor Tc is connected to a compensation signal line, and a second electrode of the compensation transistor is connected to a corresponding data line 200. It should be noted that the first power supply signal line PVDD may further serve as the compensation signal line as shown in FIG. 8, or a second power supply signal line PVEE may further serve as the compensation signal line, or the initialization signal line VREF may further serve as the compensation signal line; of course, the compensation signal line may be other signal lines different from the above signal lines, and a compensation electrical signal is provided by a driver chip IC. When an existing signal line in the display panel further serves as the compensation signal line, the difficulty of the layout may be reduced, and the influence of an introduced increment on the overall design is avoided. When it is found that the brightness of the display panel is increased, the first power supply signal line PVDD may further serve as the compensation signal line, and the compensation unit CC provides a high level for the data line 200, so that the first node N1 increases reverse leakage to the high level, the potential of the node N1 is increased, the brightness of the display panel is pulled down, and the flicker is avoided. Similarly, when the brightness of the display panel is decreased, the second power supply signal line PVEE or the initialization signal line VREF may further serve as the compensation signal line, and the compensation unit CC provides a low level for the data line 200, so that the first node N1 increases reverse leakage to the low level, the potential of the node N1 is decreased, the brightness of the display panel is improved, and the flicker is avoided.

Figure 15:
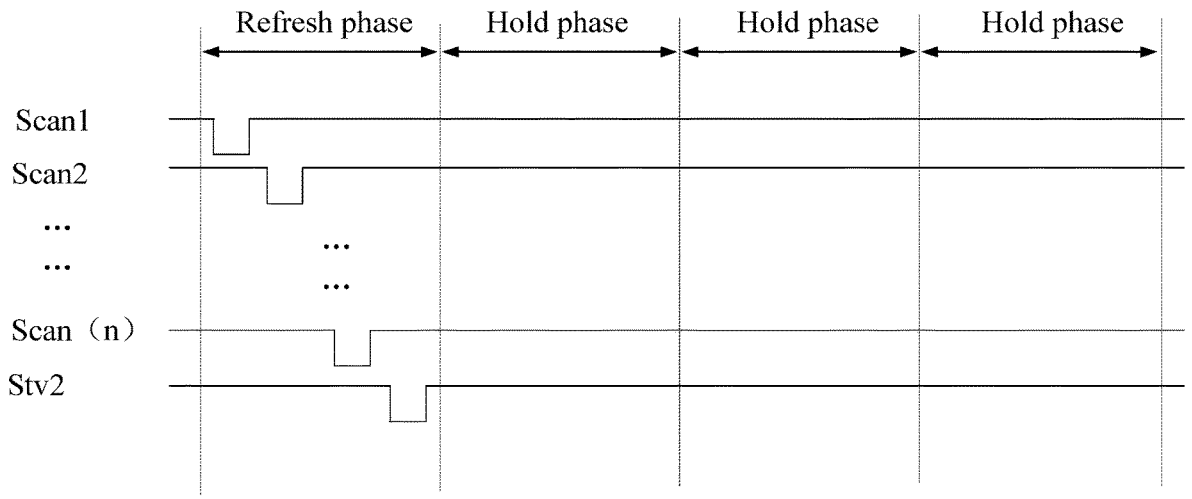
FIG. 15 is a schematic diagram showing a working timing of a display panel according to another embodiment of the present application.

Optionally, referring to FIGS. 8 and 15, FIG. 15 is a schematic diagram showing a working timing of a display panel according to another embodiment of the present application. In the compensation unit CC1, a gate electrode of the compensation transistor Tc is connected to a second initial signal line STV2, and an effective level of a second initial signal Stv2 is located after an effective level of an $n_{th}$ stage scan drive signal Scan(n) output by the $n_{th}$ stage scan driver circuit unit SCAN(n). That is to say, after all pixel rows of the display panel complete data signal write, an effective level is provided for the compensation transistor Tc, so that the compensation transistor Tc is switched on, a signal on the compensation signal line is transmitted to a corresponding data line 200, whereby reverse compensation of the leakage current is achieved, and the flicker is alleviated.

Using the second initial signal Stv2 to control the compensation transistor Tc to perform reverse compensation for the leakage current may have higher flexibility. Specifically, reference is made to FIG. 15.

When the display panel is in a first frequency mode, the display panel includes a refresh phase and a hold phase per frame; where a drive frequency of the first frequency mode is less than or equal to 30 Hz. In the refresh phase, a data signal is written into the drive transistor, and at the end of the refresh phase, the current compensation signal is written into a corresponding data line. Further, referring to FIG. 15, the first frequency mode being 15 Hz is used as an example, that is to say, the display panel displays 15 frames of image within 1 second. One refresh phase and three hold phases are included in each frame. In the embodiment, at the end of the refresh phase, the compensation unit CC is controlled by the second initial signal Stv2, and provides the current compensation signal to the data line 200; in the hold phase, the compensation unit CC is controlled by the second initial signal Stv2 and does not provide the current compensation signal to the data line 200.

Or, in another embodiment of the present application, at the end of the refresh phase, the compensation unit CC is controlled by the second initial signal Stv2, provides the current compensation signal to the data line 200; in the hold phase, the compensation unit CC is controlled by the second initial signal Stv2 and continuously provides the current compensation signal to the data line 200.

Figure 16:
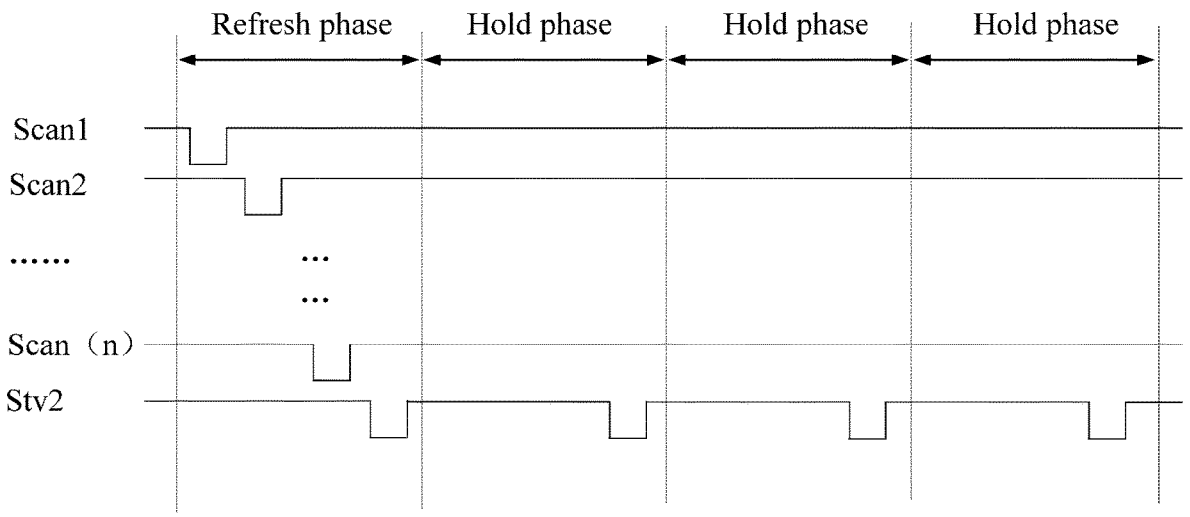
FIG. 16 is a schematic diagram showing a working timing of a display panel according to still another embodiment of the present application.

Or, referring to FIG. 16, FIG. 16 is a schematic diagram showing a working timing of a display panel according to still another embodiment of the present application. In still another embodiment of the present application, at the end of the refresh phase, the compensation unit CC is controlled by the second initial signal Stv2, and provides the current compensation signal to the data line 200; at the end of each hold phase, the compensation unit CC is controlled by the second initial signal Stv2, and continuously provides the current compensation signal to the data line 200. Adjacent effective pulses of the second initial signals Stv2 are the same as much as possible, reverse leakage is more uniform, a compensation process is divided into multiple times, so that the brightness change is smoother, and the flicker under the low-frequency driving is avoided.

Moreover, in an embodiment in which the compensation transistor Tc is controlled by adopting the second initial signal Stv2, a brightness detection unit may be provided, and when the brightness detection unit detects a change in brightness, if it is in the refresh phase at this time, then the second initial signal Stv2 controls the compensation unit to provide the current compensation signal to the data line 200 at the end of the refresh phase; and if it is in the hold phase at this time, then the second initial signal Stv2 immediately controls the compensation unit to provide the current compensation signal to the data line.

In another embodiment of the present application, referring to FIG. 9, FIG. 9 shows a schematic diagram of a display panel according to another embodiment of the present application. In the embodiment, in the compensation unit CC4, a gate electrode of the compensation transistor Tc is connected to an $(n+1)_{th}$ stage scan driver circuit unit SCAN(n+1). In the embodiment, a next stage scan driver circuit unit SCAN (n+1) cascaded with a scan driver circuit unit SCAN (n) is arranged after the scan driver circuit unit SCAN (n) corresponding to a last pixel row, and a pulse of an effective signal output by the $(n+1)_{th}$ stage scan driver circuit unit SCAN (n+1) may be located after the $n_{th}$ stage scan driver circuit unit SCAN (n) by using the characteristic of a shift register that a signal is transmitted stage by stage. Therefore, after the data signal is written, the compensation unit is controlled by the $(n+1)_{th}$ stage scan driver circuit unit SCAN (n+1) to transmit a current compensation signal to the data line 200. According to the embodiment, the reverse compensation for the leakage current can be realized without adding an additional control signal line to the compensation circuit, so that the flicker is avoided. Similarly, for the higher and lower brightness of the display panel, the compensation transistor Tc may be connected to a corresponding compensation signal line, which has the same principle as the foregoing embodiment and is not repeated herein.

Figure 14:
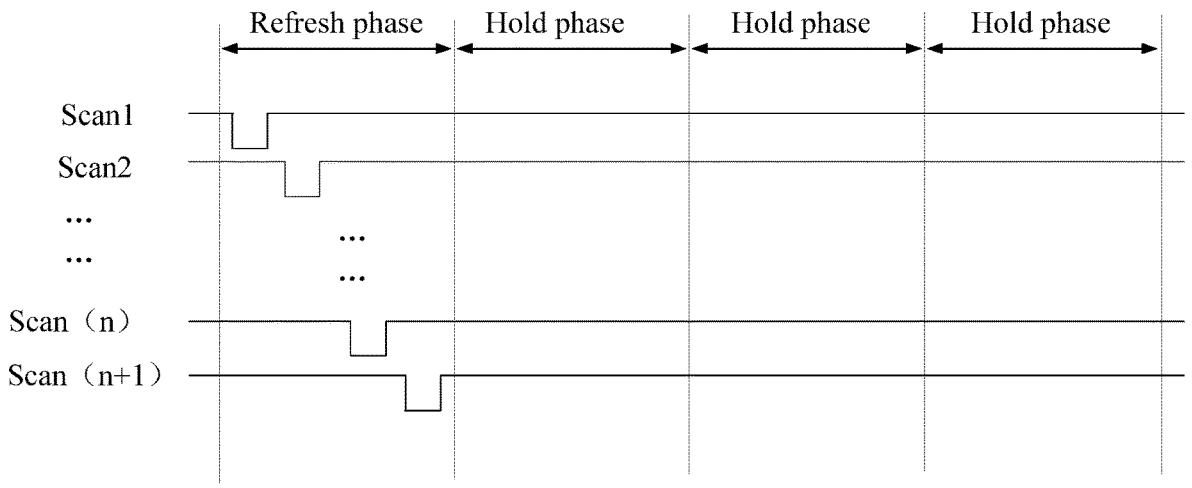
FIG. 14 is a schematic diagram showing a working timing of a display panel according to an embodiment of the present application.

With continued reference to FIG. 14, FIG. 14 is a schematic diagram showing a working timing of a display panel according to an embodiment of the present application. When the display panel is in a first frequency mode, the display panel includes a refresh phase and a hold phase per frame; where a drive frequency of the first frequency mode is less than or equal to 30 Hz. In the refresh phase, a data signal is written into the drive transistor, and at the end of the refresh phase, the current compensation signal is written into a corresponding data line. Further, referring to FIG. 14, the first frequency mode being 15 Hz is used as an example, that is to say, the display panel displays 15 frames of image within 1 second. One refresh phase and three hold phases are included in each frame. In the embodiment, at the end of the refresh phase, the compensation unit CC is controlled by a scan signal Scan (n+1) output by the $(n+1)_{th}$ stage scan driver circuit unit SCAN (n+1) and provides the current compensation signal to the data line 200; in the hold phase, no current compensation signal is provided to the data line 200.

In another embodiment of the present application, referring to FIG. 9, the compensation unit CC5 includes a first transistor T1 and a second transistor T2, a first electrode of the first transistor T1 is electrically connected to a first power supply line PVDD; a second electrode of the first transistor T1 is connected to a first electrode of the second transistor T2, and a second electrode of the second transistor T2 is connected to a corresponding data line 200; a gate electrode of the first transistor T1 and a gate electrode of the second transistor T2 are both connected to an $(n+1)_{th}$ stage scan driver circuit unit SCAN (n+1). Or, referring to the compensation unit CC2 shown in FIG. 8, the gate electrode of the second transistor T1 and the gate electrode of the first transistor T2 are both connected to the second initial signal line STV2. When the gate electrode of the first transistor T1 and the gate electrode of the second transistor T2 are connected to the SCAN (n+1), the difficulty of the layout is reduced without adding an additional control signal line. When the gate electrode of the first transistor and the gate electrode of the second transistor are connected to the second initial signal line STV2, the opportunity and the duration of the reverse compensation of the leakage current may be flexibly adjusted through the STV2, and the flexible adjustment may be carried out according to a use scene.

In addition, except the gate electrode, a connection manner of the first transistor T1 is the same as that of the light-emitting control transistor TA in the pixel driver circuit PC, and a connection manner of the second transistor T2 is the same as that of the data write transistor TB, so that the first transistor T1 and the second transistor T2 may adopt a similar layout design without extra design; therefore, the design cost and period are reduced, and thus the efficiency is improved.

Further, referring to FIGS. 4 to 7, a pixel driver circuit in a second row is used as an example. A light-emitting control signal terminal of the pixel driver circuit in the second row receives a light-emitting control signal Emit (2), a first scan signal terminal of the pixel driver circuit in the second row receives a first scan signal Scan1 (2), and a second scan signal terminal of the pixel driver circuit in the second row receives a second scan signal Scan2 (2). Referring to FIG. 5, a pulse and a phase of the first scan signal Scan1 (2) of the pixel driver circuit in the second row may be the same as a pulse and a phase of the second scan signal Scan2 (1) of the pixel driver circuit in the first row, so that the second scan signal of the pixel driver circuit in the first row may further serve as the first scan signal of the pixel driver circuit in the second row. And so on, a second scan signal of a pixel driver circuit in an $i_{th}$ row of may further serve as a first scan signal of a pixel driver circuit in an $(i+1)_{th}$ row. Therefore, a scan signal output by the $i_{th}$ stage scan driver circuit unit may be connected to an $i_{th}$ pixel row as a second scan signal of the $i_{th}$ pixel row, and meanwhile connected to an $(i+1)_{th}$ pixel row as a first scan signal of the $(i+1)_{th}$ pixel row. With continued reference to FIG. 9, for example, a scan signal output by the $(n-1)_{th}$ stage scan driver circuit unit is also connected to a pixel driver circuit in an $n_{th}$ row as a second scan signal for the pixel driver circuit in the $n_{th}$ row. However, because the display panel only has n pixel rows, it means that a second scan signal corresponding to the $n_{th}$ stage scan driver circuit cannot be connected to a next pixel row. Therefore, the $(n-1)_{th}$ stage scan driver circuit is connected to two pixel rows, while the $n_{th}$ stage scan driver circuit is only connected to one pixel row, so that the load of the $n_{th}$ stage scan driver circuit is not uniform. In the embodiment, the $n_{th}$ stage scan driver circuit is connected to the compensation unit CC, so that the compensation unit CC may increase the load of the $n_{th}$ stage scan driver circuit, so that the load of the display panel is balanced, and the stability of the scan driver circuit and the display uniformity of the display panel are improved.

Specifically, a gate electrode of the first transistor T1 is connected to the $n_{th}$ stage scan driver circuit unit SCAN (n) to increase the load of the $n_{th}$ stage scan driver circuit unit, so that the load is balanced and the display is uniform.

Further, referring to FIG. 10, FIG. 10 shows a schematic diagram of a display panel according to still another embodiment of the present application. The gate electrode of the second transistor T2 is connected to the second initial signal line, and an effective level of a second initial signal is located after an effective level of an $n_{th}$ scan drive signal output by the $n_{th}$ stage scan driver circuit unit. Or, the gate electrode of the second transistor T2 is connected to the $(n+1)_{th}$ stage scan driver circuit unit. When the gate electrode of the second transistor T2 is connected to the second initial signal line STV2, the compensation effect of the current compensation signal may be controlled by controlling a time point of the effective pulse of the STV2. For example, through widening a pulse width of the STV2, the compensation time is increased, and the compensation effect is improved. Or, the second initial signal is provided after the brightness attenuation is detected, so that more effective current compensation is performed.

Further, since a signal compensated to the data line 200 by the second transistor T2 is transmitted to the first electrode of the second transistor T2 by the first transistor T1 when the $n_{th}$ stage scan driver circuit unit outputs an effective signal, a problem that a voltage signal cannot be maintained because this compensated voltage is stored only by a parasitic capacitor may occur, and thus, in the embodiment, the compensation unit CC7 further includes a first capacitor C1, the first capacitor C1 is electrically connected between the second electrode of the first transistor T1 and a fixed potential signal line. The first capacitor C1 may store the compensation signal transmitted by the first transistor T1 for a long time, so that attenuation of the compensation signal is avoided, and the compensation effect is improved. On the other hand, when the second transistor T2 is turned on and a voltage for compensation stored in the first capacitor C1 is transmitted to the data line, the first transistor T1 is turned off at this time, so that the influence on the potential on the signal line when the first power supply signal line PVDD or other signal lines further serve as the compensation signal line is avoided, and the display abnormality caused by the resulting fluctuation or burrs is avoided.

In another embodiment of the present application, referring to FIG. 9, the compensation unit CC6 includes a third transistor T3, a fourth transistor T4, a fifth transistor T5, and a sixth transistor T6. A first electrode of the third transistor T3 is connected to an initialization signal line VREF, a second electrode of the third transistor T3 is connected to a first electrode of the fourth transistor T4 and a gate electrode of the fifth transistor T5, a second electrode of the fourth transistor T4 is connected to a second electrode of the fifth transistor T5, and a first electrode of the fifth transistor T5 is connected to a second electrode of the sixth transistor T6, a first electrode of the sixth transistor T6 is connected to a corresponding data line 200, and a gate electrode of the third transistor, a gate electrode of the fourth transistor and a gate electrode of the sixth transistor are connected to the $(n+1)_{th}$ stage scan driver circuit unit. When the $(n+1)_{th}$ stage scan driver circuit unit outputs a pulse of an effective level, the third transistor T3 is switched on, the initialization signal Vref is transmitted to the gate electrode of the fifth transistor T5 so that the fifth transistor T5 is switched on, and meanwhile, the fourth transistor and the sixth transistor are switched on, and the initialization signal Vref is provided to the data line 200 through the sixth transistor T6, the fifth transistor T5 and the fourth transistor T4 so as to perform the leakage current compensation. When the gate electrode of the third transistor T3, the gate electrode of the fourth transistor T4 and the gate electrode of the sixth transistor T6 are connected to the $(n+1)_{th}$ stage scan driver circuit unit, whereby the difficulty of the layout is reduced without adding an additional control signal line.

Or, referring to the compensation unit CC3 shown in FIG. 8, the gate electrode of the third transistor T3, the gate electrode of the fourth transistor T4 and the gate electrode of the sixth transistor T6 are connected to the second initial signal line STV2, and an effective level of a second initial signal is located after an effective level of an $n_{th}$ stage scan drive signal output by the $n_{th}$ stage scan driver circuit unit. When the second initial signal line STV2 outputs a pulse of an effective level, the third transistor T3 is switched on, the initialization signal Vref is transmitted to the gate electrode of the fifth transistor T5 so that the fifth transistor T5 is switched on, and meanwhile, the fourth transistor and the sixth transistor are switched on, and the initialization signal Vref is provided to the data line 200 through the sixth transistor T6, the fifth transistor T5 and the fourth transistor T4 so as to perform the leakage current compensation. When the gate electrode of the third transistor T3, the gate electrode of the fourth transistor T4 and the gate electrode of the sixth transistor T6 are connected to the second initial signal line STV2, the opportunity and the duration of the reverse compensation of the leakage current may be flexibly adjusted through the STV2, and the flexible adjustment may be carried out according to a use scene.

In addition, except the gate electrode, a connection manner of the third transistor T3 is the same as that of the gate electrode initialization transistor TC in the pixel driver circuit PC, a connection manner of the fourth transistor T4 is the same as that of the compensation transistor TD, a connection manner of the fifth transistor T5 is the same as that of the drive transistor DT, and a connection manner of the sixth transistor T6 is the same as that of the data write transistor TB. Therefore, the third transistor T3, the fourth transistor T4, the fifth transistor T5 and the sixth transistor T6 may adopt a similar layout design without extra design; therefore, the design cost and period are reduced, and thus the efficiency is improved.

Moreover, the $n_{th}$ stage scan driver circuit is connected to the compensation unit CC, the load of the $n_{th}$ stage scan driver circuit is increased, so that the load of the display panel is balanced, and the stability of the scan driver circuit and the display uniformity of the display panel are improved. In an embodiment, referring to FIG. 10, the compensation unit CC8 includes a third transistor T3, a fourth transistor T4, a fifth transistor T5, and a sixth transistor T6. A first electrode of the third transistor T3 is connected to an initialization signal line VREF, a second electrode of the third transistor T3 is connected to a first electrode of the fourth transistor T4 and a gate electrode of the fifth transistor T5, a second electrode of the fourth transistor T4 is connected to a second electrode of the fifth transistor T5, a first electrode of the fifth transistor T5 is connected to a second electrode of the sixth transistor T6, a first electrode of the sixth transistor T6 is connected to a corresponding data line 200. A gate electrode of the third transistor T3 is electrically connected to the $n_{th}$ stage scan driver circuit unit SCAN (n). The $n_{th}$ stage scan driver circuit unit is connected to two rows simultaneously, and the load of the $n_{th}$ stage scan driver circuit unit is increased by using the compensation unit. A gate electrode of the fourth transistor T4 and a gate electrode of the sixth transistor T6 are connected to the second initial signal line STV2, and an effective level of a second initial signal is located after an effective level of an $n_{th}$ stage scan drive signal output by the $n_{th}$ stage scan driver circuit unit. When the $n_{th}$ stage scan driver circuit unit outputs a pulse of an effective level, the third transistor T3 is switched on, and the initialization signal Vref is transmitted to the gate electrode of the fifth transistor T5, so that the fifth transistor T5 is switched on. When the second initial signal STV2 outputs a pulse of an effective level, the fourth transistor T4 and the sixth transistor T6 are switched on, and the initialization signal Vref is provided to the data line 200 through the sixth transistor T6, the fifth transistor T5 and the fourth transistor T4 so as to perform the current compensation. When the fourth transistor and the sixth transistor are connected to the second initial signal line STV2, the compensation effect of the current compensation signal may be controlled by controlling a time point of the effective pulse. For example, through widening a pulse width of the STV2, the compensation time is increased, and the compensation effect is improved. Or the second initial signal is provided after the brightness attenuation is detected, so that more effective current compensation is performed.

Or, the gate electrode of the fourth transistor T4 and the gate electrode of the sixth transistor T6 are connected to the $(n+1)_{th}$ stage scan driver circuit unit SCAN (n+1). When the $n_{th}$ stage scan driver circuit unit outputs a pulse of an effective level, the third transistor T3 is switched on, and the initialization signal Vref is transmitted to the gate electrode of the fifth transistor T5, so that the fifth transistor T5 is switched on. When the $(n+1)_{th}$ stage scan driver circuit unit outputs a pulse of an effective level, the fourth transistor T4 and the sixth transistor T6 are switched on, and the initialization signal Vref is provided to the data line 200 through the sixth transistor T6, the fifth transistor T5 and the fourth transistor T4 so as to perform the current compensation. When the gate electrode of the fourth transistor T4 and the gate electrode of the sixth transistor T6 are connected to the $(n+1)_{th}$ stage scan driver circuit unit, whereby the difficulty of the layout may be reduced without increasing signal lines and changing the layout design.

Further, in order to avoid a problem that a signal compensated to the data line 200 by the sixth transistor T6 may be a voltage signal that cannot be maintained because this compensated voltage is stored only by a parasitic capacitor, in the embodiment, the compensation unit CC8 further includes a second capacitor C2, and the second capacitor C2 is electrically connected between the second electrode of the third transistor T3 and a fixed potential signal line. The storage capacitor C2 may store the compensation signal transmitted by the third transistor T3 for a long time, so that attenuation of the compensation signal is avoided, and the compensation effect is improved. On the other hand, when the sixth transistor T6 is turned on and a voltage for compensation stored in the first capacitor C1 is transmitted to the data line, the third transistor T3 is turned off at this time, so that the influence on the potential on the signal line when the initialization signal line VREF or other signal lines further serve as the compensation signal line is avoided, and the display abnormality caused by the resulting fluctuation or burrs is avoided.

In another embodiment of the present application, in the display area AA, a row of pixel driver circuits is arranged above any row of pixel driver circuit in the middle and a row of pixel driver circuits is arranged below the any row of pixel driver circuit in the middle, while no pixel driver circuit is arranged below a last row of pixel driver circuits, so that loads of the last row of pixel driver circuits are different; and in an etching process, over-etching may be caused due to a fact that no pixel driver circuit is arranged below the last row of pixel driver circuits, and finally display abnormality is caused. In the embodiment, the structure of the compensation circuit CC is as close or even the same as that of the pixel driver circuit in the display area, so that the load uniformity and the etching uniformity can be ensured.

Figure 11:
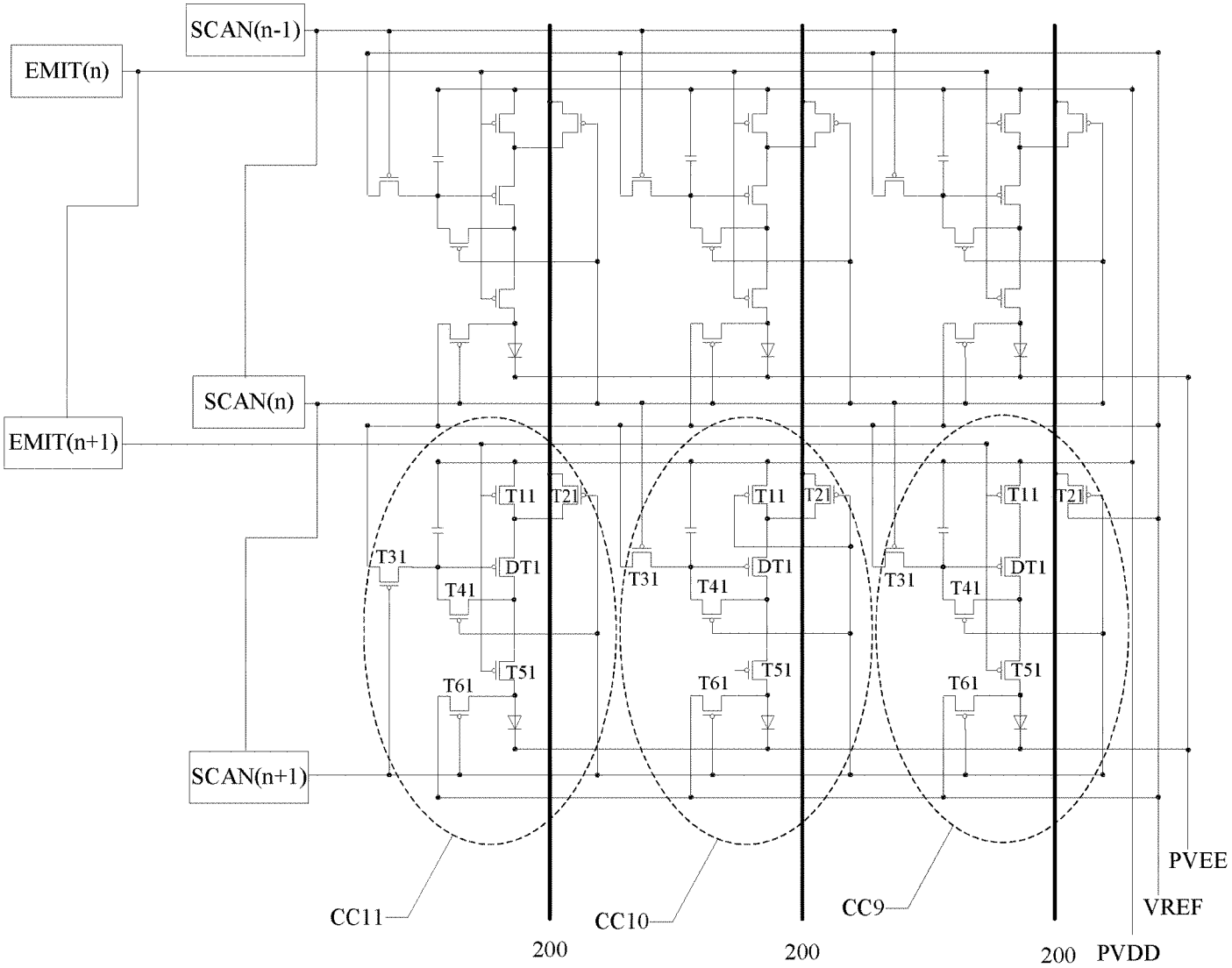
FIG. 11 shows a schematic diagram of a display panel according to still another embodiment of the present application.
Figure 12:
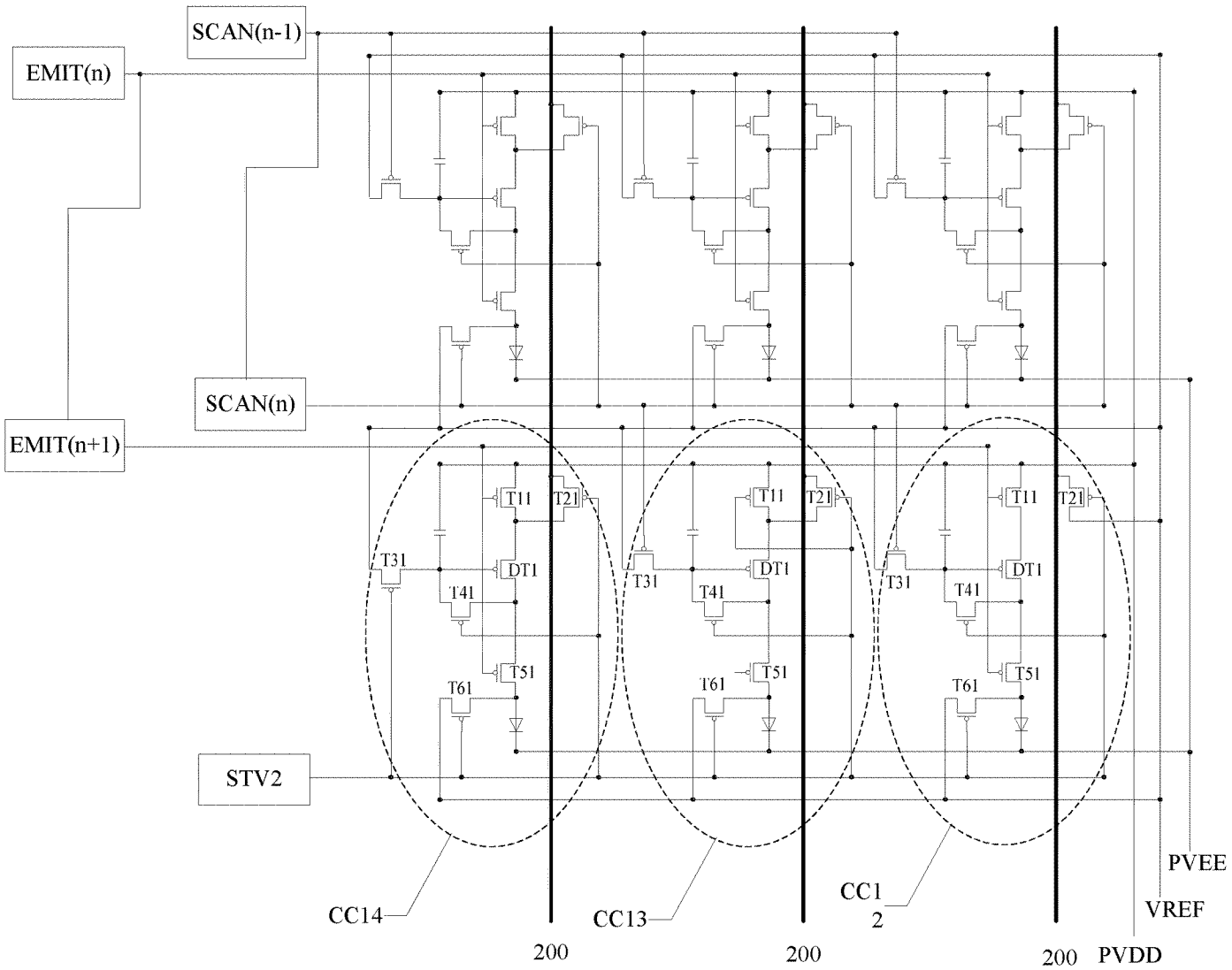
FIG. 12 shows a schematic diagram of a display panel according to still another embodiment of the present application.
Figure 13:
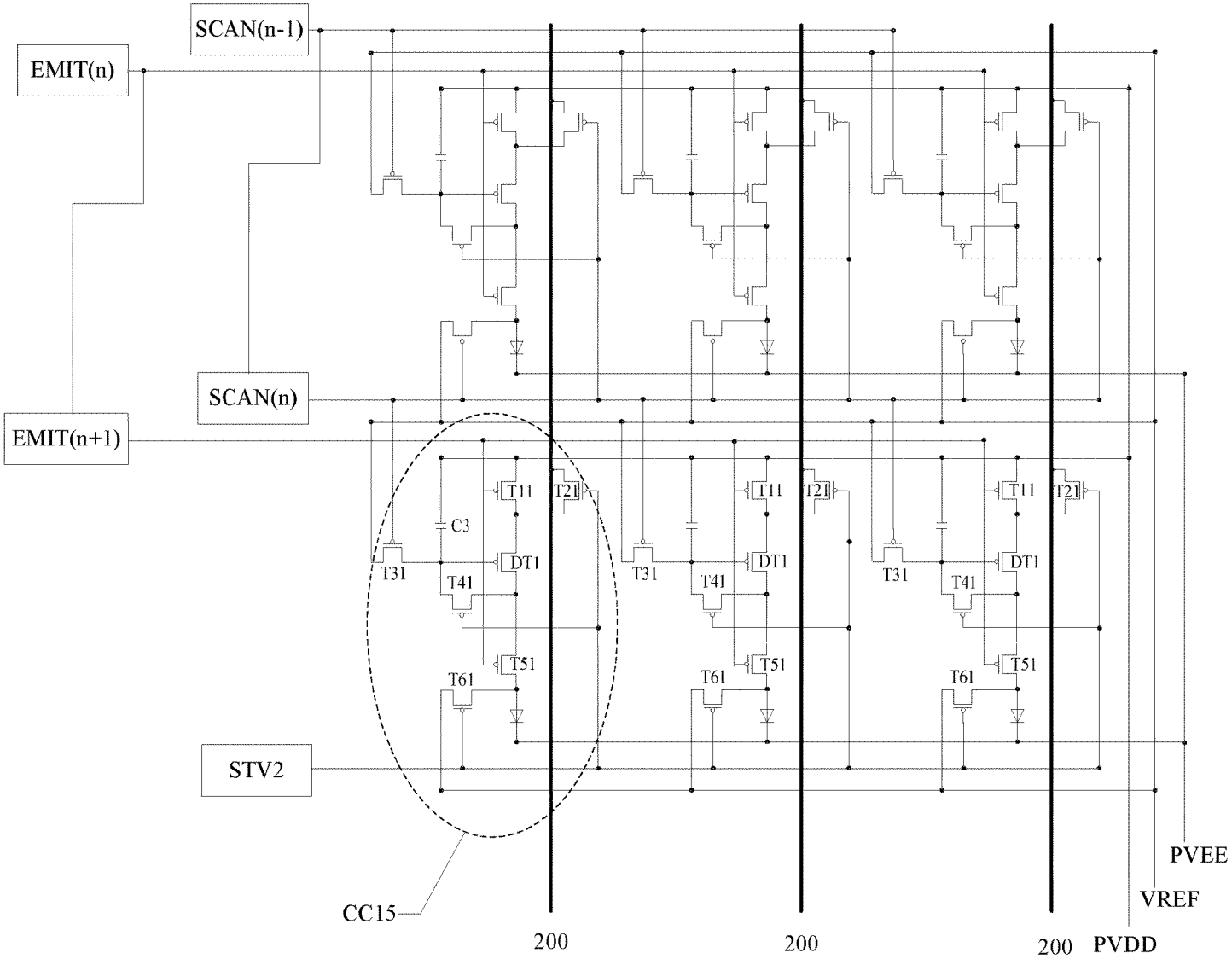
FIG. 13 shows a schematic diagram of a display panel according to still another embodiment of the present application.

Specifically, referring to FIGS. 11 to 13, FIG. 11 shows a schematic diagram of a display panel according to still another embodiment of the present application; FIG. 12 shows a schematic diagram of a display panel according to still another embodiment of the present application; FIG. 13 shows a schematic diagram of a display panel according to still another embodiment of the present application. In the embodiments, in combination with FIG. 4, a pixel driver circuit PC includes a drive transistor DT, a data write transistor TB, a light-emitting control transistor TA, a gate electrode initialization transistor TC, and a threshold compensation transistor TD.

The light-emitting control transistor TA, the drive transistor DT and the light-emitting element OLED are connected in series between the first power supply voltage end PVDD and the second power supply voltage end PVEE; the threshold compensation transistor TD is connected between a gate electrode and a second electrode of the drive transistor DT; the gate electrode initialization transistor TC is connected to the gate electrode of the drive transistor DT; and the data write transistor TB connected between a data line 100 and a first electrode of the drive transistor DT.

The compensation unit CC includes a compensation pixel driver circuit. The compensation pixel driver circuit includes a dummy drive transistor DT1, a dummy data write transistor T21, a dummy light-emitting control transistor T11, a dummy gate electrode initialization transistor T31 and a dummy threshold compensation transistor T41. The dummy light-emitting control transistor T11 is connected in series with the dummy drive transistor TD1; the dummy threshold compensation transistor T41 is connected between a gate electrode and a second electrode of the dummy drive transistor DT1; and the dummy gate electrode initialization transistor T31 is connected to the gate electrode of the dummy drive transistor DT1.

In an embodiment of the present application, referring to FIGS. 11 and 12, a first electrode of the dummy data write transistor T21 is connected to a power supply signal line; and a second electrode of the dummy data write transistor is connected to a corresponding data line. The power supply signal line described here may be a first power supply signal line PVDD or an initialization signal line VREF or a second power supply signal line PVEE or other power supply signal lines. As shown by the compensation unit CC9 in FIG. 11, a gate electrode of the dummy data write transistor T21 is connected to an $(n+1)_{th}$ stage scan driver circuit unit. When the $(n+1)_{th}$ stage scan driver circuit unit SCAN (n+1) outputs a pulse of an effective level, a leakage current compensation signal on the power supply signal line is transmitted to a corresponding data line 200 through the dummy data write transistor T21 so as to perform the leakage current compensation.

Or, as shown in the compensation unit CC12 in FIG. 12, the gate electrode of the dummy data write transistor T21 is connected to the second initial signal line STV2, and an effective level of the second initial signal STV2 is located after the effective level of an $n_{th}$ stage scan drive signal output by the $n_{th}$ stage scan driver circuit unit. When the second initial signal line STV2 outputs a pulse of an effective level, a leakage current compensation signal on the power supply signal line is transmitted to a corresponding data line 200 through the dummy data write transistor T21 so as to perform the leakage current compensation.

It should be noted that the compensation unit may further include a dummy second light-emitting control transistor T51 and a dummy light-emitting element initialization transistor T61. The dummy second light-emitting control transistor T51 is connected to a second electrode of the dummy drive transistor DT1, and the dummy light-emitting element initialization transistor T61 is connected to a second electrode of the dummy second light-emitting control transistor T51. When the pixel driver circuit PC further includes other transistor, the compensation unit may further include dummy a transistor with a same connection manner as the other transistor in the compensation unit, which is not limited by the present application.

In another embodiment, referring to FIG. 11, in the compensation unit CC10, the dummy data write transistor T21 is connected between the data line 200 and a first electrode of the dummy drive transistor DT; a gate electrode of the dummy light-emitting control transistor T11 and a gate electrode of the dummy data write transistor T21 are connected to the $(n+1)_{th}$ stage scan driver circuit unit. When the $(n+1)_{th}$ stage scan driver circuit unit outputs a pulse signal of an effective level, the dummy data write transistor T21 and the dummy light-emitting control transistor T11 are turned on, and a first power supply voltage signal Pvdd is transmitted to a corresponding data line so as to perform the leakage current compensation.

Or, referring to FIG. 12, in the compensation unit CC13, a gate electrode of the dummy light-emitting control transistor T11 and a gate electrode of the dummy data write transistor T21 are connected to the second initial signal line STV2, and an effective level of a second initial signal is located after an effective level of an $n_{th}$ stage scan drive signal output by the $n_{th}$ stage scan driver circuit unit. When the second initial signal line outputs a pulse signal of an effective level, the dummy data write transistor T21 and the dummy light-emitting control transistor T11 are turned on, and the first power supply voltage signal Pvdd is transmitted to a corresponding data line so as to perform the leakage current compensation.

In another embodiment of the present application, the dummy data write transistor T21 is connected between the data line 200 and a first electrode of the dummy drive transistor DT1. Referring to FIG. 11, in the compensation unit CC11, a gate electrode of the dummy gate electrode initialization transistor T31, a gate electrode of the dummy threshold compensation transistor T41, and a gate electrode of the dummy data write transistor T21 are connected to the $(n+1)_{th}$ stage scan driver circuit unit. When the $(n+1)_{th}$ stage scan driver circuit unit outputs a pulse signal of an effective level, the dummy data write transistor T21 and the dummy light-emitting control transistor T11 are turned on, and the first power supply voltage signal Pvdd is transmitted to a corresponding data line so as to perform the leakage current compensation.

Or, referring to FIG. 12, in the compensation unit CC14, a gate electrode of the dummy gate electrode initialization transistor T31, a gate electrode of the dummy threshold compensation transistor T41, and a gate electrode of the dummy data write transistor T21 are connected to the second initial signal line STV2, and an effective level of a second initial signal is located after an effective level of an $n_{th}$ stage scan drive signal Scan(n) output by the $n_{th}$ stage scan driver circuit unit. When the second initial signal line outputs a pulse signal of an effective level, the dummy data write transistor T21 and the dummy light-emitting control transistor T11 are turned on, and the first power supply voltage signal Pvdd is transmitted to a corresponding data line so as to perform the leakage current compensation.

In another embodiment of the present application, referring to FIG. 13, the compensation unit CC15 further includes a dummy storage capacitor C3. The dummy storage capacitor C3 is connected between a gate electrode of the dummy drive transistor DT1 and the first power supply voltage end PVDD; the dummy data write transistor T21 is connected between the data line 200 and the first electrode of the dummy drive transistor DT1; a gate electrode of the dummy grid initialization transistor T11 is connected to the $n_{th}$ stage scan driver circuit unit; a gate electrode of the dummy threshold compensation transistor T41 and a gate electrode of the dummy data write transistor T21 are connected to the $(n+1)_{th}$ stage scan driver circuit unit SCAN (n+1). When the $n_{th}$ stage scan driver circuit unit outputs a pulse signal of an effective level, the initialization signal Vref is transmitted to the dummy storage capacitor C3, and when the (n+stage scan driver circuit unit outputs a pulse signal of an effective level, the dummy data write transistor T21 and the dummy threshold compensation transistor T41 are turned on, and the initialization signal Vref is transmitted to a corresponding data line 200 so as to perform the leakage current compensation.

Or, the gate electrode of the dummy threshold compensation transistor T41 and the gate electrode of the dummy data write transistor T21 are connected to the second initial signal line STV2, and an effective level of a second initial signal is located after an effective level of an $n_{th}$ stage scan drive signal output by the $n_{th}$ stage scan driver circuit unit. When the second initial signal line outputs a pulse signal of an effective level, the dummy data write transistor T21 and the dummy light-emitting control transistor T11 are turned on, and the first power supply voltage signal Pvdd is transmitted to a corresponding data line so as to perform the leakage current compensation.

When the $n_{th}$ stage scan driver circuit unit outputs a pulse signal of an effective level, the initialization signal Vref is transmitted to the dummy storage capacitor C3, and when the second initial signal outputs a pulse signal of an effective level, the dummy data write transistor T21 and the dummy threshold compensation transistor T41 are turned on, and the initialization signal Vref is transmitted to the corresponding data line 200 so as to perform the leakage current compensation.

In order to avoid a problem that the compensated voltage may be a voltage signal which cannot be maintained, in an embodiment, the compensation unit CC8 further includes a second capacitor C2, and the second capacitor C2 is electrically connected between a second electrode of the third transistor T3 and a fixed potential signal line. The storage capacitor C2 may store a compensation signal transmitted by the third transistor T3 for a long time, so that attenuation of the compensation signal is avoided, and the compensation effect is improved. On the other hand, when the sixth transistor T6 is turned on and a voltage for compensation stored in the first capacitor C1 is transmitted to the data line, the third transistor T3 is turned off at this time, so that the influence on the potential on the signal line when the initialization signal line VREF or other signal lines further serve as the compensation signal line is avoided, and the display abnormality caused by the resulting fluctuation or burrs is avoided.

It should be noted that the foregoing has described that the potential of the drive transistor gate electrode node N1 may leak to a low current, thereby resulting in a higher brightness. It is also possible to leak electricity to a high current, thereby resulting in a lower brightness. Therefore, the corresponding compensation unit CC may transmit a high level to the data line 200, compensate for the leakage current, and decrease the brightness; or may transmit a low level to the data line 200 to compensate for the leakage current and increase the brightness. Different compensation units provided in the present application may be employed according to different leakage currents.

In addition, a method for driving a display panel is provided in the present application.

Referring to FIGS. 8, 12 and 15, the compensation units CC1, CC2, CC3, CC12, CC13 and CC14 are controlled by the second initial signal Stv2, when the second initial signal line STV2 outputs an effective level, a leakage current compensation signal is written into the data line 200, and an effective level of the second initial signal Stv2 is located after an effective level of an $n_{th}$ stage scan drive signal Scan(n) output by the $n_{th}$ stage scan driver circuit unit SCAN(n). That is to say, after all pixel rows of the display panel complete data signal write, a signal on the compensation signal line is transmitted to a corresponding data line 200, whereby reverse compensation of the leakage current is achieved, and the flicker is reduced.

Using the second initial signal Stv2 to control the reverse compensation of the leakage current may have higher flexibility. Specifically, reference can be made to FIG. 15.

When the display panel is in the first frequency mode, the display panel includes a refresh phase and a hold phase per frame; where a drive frequency of the first frequency mode is less than or equal to 30 Hz. In the refresh phase, a data signal is written into the drive transistor, and at the end of the refresh phase, a current compensation signal is written into a corresponding data line. Further, referring to FIG. 15, the first frequency mode being 15 Hz is used as an example, that is to say, the display panel displays 15 frames of image within 1 second. One refresh phase and three hold phases are included in each frame. In the embodiment, at the end of the refresh phase, the compensation unit is controlled by the second initial signal Stv2, and provides a current compensation signal to the data line 200; in the hold phase, the compensation unit CC is controlled by the second initial signal Stv2 and does not provide the current compensation signal to the data line 200.

Or, in another embodiment of the present application, at the end of the refresh phase, the compensation unit CC is controlled by the second initial signal Stv2, provides the current compensation signal to the data line 200; in the hold phase, the compensation unit CC is controlled by the second initial signal Stv2 and continuously provides the current compensation signal to the data line 200.

Or, referring to FIG. 16, FIG. 16 is a schematic diagram showing a working timing of a display panel according to still another embodiment of the present application. In still another embodiment of the present application, at the end of the refresh phase, the compensation unit CC is controlled by the second initial signal Stv2, and provides the current compensation signal to the data line 200; at the end of each hold phase, the compensation unit CC is controlled by the second initial signal Stv2, and continuously provides the current compensation signal to the data line 200. Adjacent effective pulses of the second initial signals Stv2 are the same as much as possible, reverse leakage is more uniform, a compensation process is divided into multiple times, so that the brightness change is smoother, and the flicker under the low-frequency driving is avoided.

Moreover, in an embodiment in which the compensation unit is controlled by the second initial signal Stv2, a brightness detection unit may be provided, and when the brightness detection unit detects a change in brightness, if it is in the refresh phase at this time, then the second initial signal Stv2 controls the compensation unit to provide the current compensation signal to the data line 200 at the end of the refresh phase; and if it is in the hold phase at this time, then the second initial signal Stv2 immediately controls the compensation unit to provide the current compensation signal to the data line.

In another embodiment of the present application, referring to FIGS. 9 and 11, with continued reference to FIG. 14, the compensation units CC4, CC5, CC6, CC9, CC10, CC11 are controlled by the $(n+1)_{th}$ stage scan drive signal Scan (n+1) output by the $(n+1)_{th}$ stage scan driver circuit unit SCAN (n+1). When the $(n+1)_{th}$ stage scan drive signal Scan (n+1) outputs an effective level, a leakage current compensation signal is written into the data line 200, that is to say, after all pixel rows of the display panel complete data signal write, a signal on the compensation signal line is transmitted to a corresponding data line 200, whereby reverse compensation of the leakage current is achieved, and the flicker is alleviated.

In the embodiment, the compensation unit is connected to the $(n+1)_{th}$ stage scan driver circuit unit SCAN (n+1). Under the control of the $(n+1)_{th}$ stage scan drive signal, a next stage scan driver circuit unit SCAN (n+1) cascaded with the scan driver circuit unit SCAN (n) is arranged after the scan driver circuit unit SCAN (n) corresponding to a last pixel row, and a pulse of an effective signal output by the $(n+1)_{th}$ stage scan driver circuit unit SCAN (n+1) may be located after a pulse of an effective signal output by the $n_{th}$ stage scan driver circuit unit SCAN (n) by using the characteristic of a shift register that a signal is transmitted stage by stage. Therefore, after the data signal is written, the compensation unit is controlled by the $(n+1)_{th}$ stage scan driver circuit unit SCAN (n+1) to transmit a current compensation signal to the data line 200. According to the embodiment, the reverse compensation of the leakage current can be realized without adding an additional control signal line to the compensation circuit, so that the flicker is avoided. Similarly, for the higher and lower brightness of the display panel, the compensation transistor Tc may be connected to a corresponding compensation signal line, which has the same principle as the foregoing embodiment and is not repeated herein.

With continued reference to FIG. 14, FIG. 14 is a schematic diagram showing a working timing of a display panel according to an embodiment of the present application. When the display panel is in the first frequency mode, the display panel includes a refresh phase and a hold phase per frame; where a drive frequency of the first frequency mode is less than or equal to 30 Hz. In the refresh phase, a data signal is written into the drive transistor, and at the end of the refresh phase, a current compensation signal is written into a corresponding data line. Further, referring to FIG. 14, the first frequency mode being 15 Hz is used as an example, that is to say, the display panel displays 15 frames of image within 1 second. One refresh phase and three hold phases are included in each frame. In the embodiment, at the end of the refresh phase, the compensation unit CC is controlled by a scan signal Scan (n+1) output by the $(n+1)_{th}$ stage scan driver circuit unit SCAN (n+1) and provides the current compensation signal to the data line 200; in the hold phase, no current compensation signal is provided to the data line 200.

Figure 17:
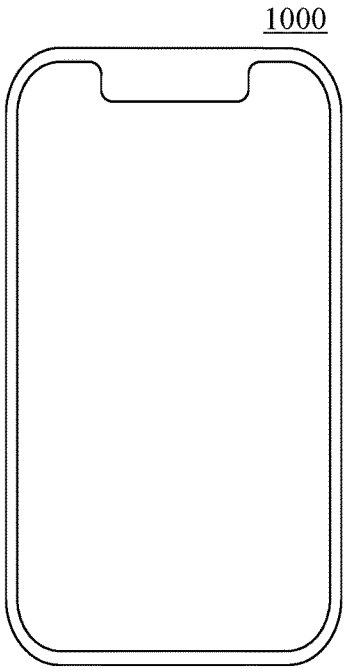
FIG. 17 shows a schematic diagram of a display device according to an embodiment of the present disclosure.

A display device provided in the present application may be any device including the compensation unit as described above, including, but not limited to, a cellular mobile phone 1000 as shown in FIG. 17, a tablet computer, a monitor of a computer, a display applied to a smart wearable apparatus, a display device mounted on a vehicle such as an automobile, and the like. As long as the display device includes the compensation unit disclosed by the present application, the display device is considered to fall within the protection scope of the present application.

With the foldable display panel and display device provided by the present application, the risk of disconnection may be reduced, the driving capability is improved, and thus the display effect and the display stability are enhanced.

It should be understood by those skilled in the art that the scope of invention involved in this application is not limited to a technical scheme formed by a specific combination of the above technical features, but also encompasses other technical scheme formed by any combination of the above-described technical features or equivalent features thereof without departing from the inventive concept, such as a technical scheme obtained by replacing one or more features described above with one or more technical features (but not limited to) having similar functions.

What is claimed is:

1. A display panel, comprising a display area and a non-display area surrounding the display area; wherein the display area comprises scan lines arranged in a second direction and each extending in a first direction, data lines arranged in the first direction and each extending in the second direction, and pixel driver circuits defined by the scan lines and the data lines intersecting with each other, the first direction intersecting the second direction;

the non-display area comprises a step area and a compensation unit, and the compensation unit is located between the step area and a last row of pixel driver circuits among the pixel driver circuits;

the compensation unit comprises at least one transistor, and one electrode of the at least one transistor is connected to a corresponding data line among the data lines and configured to transmit a leakage current compensation signal to the corresponding data line;

a working process of the display panel comprises a refresh phase, the compensation unit is configured to write the leakage current compensation signal into the corresponding data line at the end of the refresh phase;

the display panel further comprising a scan driver circuit, wherein the scan driver circuit comprises cascaded scan driver circuit units, an $i_{th}$ row of scan line is connected to an $i_{th}$ stage scan driver circuit unit, a $n_{th}$ stage scan driver circuit unit is connected to a last row of scan line, an input terminal of a first stage scan driver circuit unit is connected to a first initial signal line, wherein $1 \leq i \leq n$, and i and n are positive integers;

the pixel driver circuit comprises a drive transistor, a data write transistor, a light-emitting control transistor, a gate electrode initialization transistor and a threshold compensation transistor, wherein the light-emitting control transistor, the drive transistor and a light-emitting element are connected in series between a first power supply voltage end and a second power supply voltage end, the threshold compensation transistor is connected between a gate electrode and a second electrode of the drive transistor, the gate electrode initialization transistor is connected to the gate electrode of the drive transistor, and the data write transistor is connected between the data line and a first electrode of the drive transistor;

and, the compensation unit comprises a compensation pixel driver circuit, the compensation pixel driver circuit comprises a dummy drive transistor, a dummy data write transistor, a dummy light-emitting control transistor, a dummy gate electrode initialization transistor and a dummy threshold compensation transistor, wherein the dummy light-emitting control transistor is connected in series with the dummy drive transistor, the dummy threshold compensation transistor is connected between a gate electrode and a second electrode of the dummy drive transistor, and the dummy gate electrode initialization transistor is connected to the gate electrode of the dummy drive transistor.

2. The display panel of claim 1, wherein a first electrode of the dummy data write transistor is connected to a power supply signal line, and a second electrode of the dummy data write transistor is connected to the corresponding data line; and a gate electrode of the dummy data write transistor is connected to an $(n+1)_{th}$ stage scan driver circuit unit; or the gate electrode of the dummy data write transistor is connected to a second initial signal line, an effective level of a second initial signal being located after an effective level of a $n_{th}$ stage scan drive signal output by the $n_{th}$ stage scan driver circuit unit.

3. The display panel of claim 1, wherein, the dummy data write transistor is connected between the data line and a first electrode of the dummy drive transistor; and a gate electrode of the dummy light-emitting control transistor and a gate electrode of the dummy data write transistor are connected to an $(n+1)_{th}$ stage scan driver circuit unit; or the gate electrode of the dummy light-emitting control transistor and the gate electrode of the dummy data write transistor are connected to a second initial signal line, an effective level of a second initial signal being located after an effective level of a $n_{th}$ stage scan drive signal output by the $n^{th}$ stage scan driver circuit unit.

4. The display panel of claim 1, wherein, the dummy data write transistor is connected between the data line and a first electrode of the dummy drive transistor; and a gate electrode of the dummy grid initialization transistor, a gate electrode of the dummy threshold compensation transistor and a gate electrode of the dummy data write transistor are connected to an $(n+1)_{th}$ stage scan driver circuit unit; or the dummy gate electrode initialization transistor, the dummy threshold compensation transistor and the dummy data write transistor are connected to a second initial signal line, an effective level of a second initial signal being located after an effective level of a $n^{th}$ stage scan drive signal output by the $n_{th}$ stage scan driver circuit unit.

5. The display panel of claim 1, further comprising a dummy storage capacitor, wherein, the dummy storage capacitor is connected between the gate electrode of the dummy drive transistor and a first power supply voltage end, and the dummy data write transistor is connected between the data line and a first electrode of the dummy drive transistor; and a gate electrode of the dummy gate electrode initialization transistor is electrically connected to the $n_{th}$ stage scan driver circuit unit, and a gate electrode of the dummy threshold compensation transistor and a gate electrode of the dummy light-emitting control transistor are connected to an $(n+1)_{th}$ stage scan driver circuit unit, or the gate electrode of the dummy threshold compensation transistor and the gate electrode of the dummy light-emitting control transistor are connected to a second initial signal line, an effective level of a second initial signal being located after an effective level of a $n_{th}$ stage scan drive signal output by the $n_{th}$ stage scan driver circuit unit.

6. A display device, comprising the display panel of claim 1.

7. The display device of claim 6, wherein the display panel further comprises a scan driver circuit, wherein the scan driver circuit comprises cascaded scan driver circuit units, an $i_{th}$ row of scan line is connected to an $i_{th}$ stage scan driver circuit unit, a $n_{th}$ stage scan driver circuit unit is connected to a last row of scan line, an input terminal of a first stage scan driver circuit unit is connected to a first initial signal line, wherein $1 \leq i \leq n$, and i and n are positive integers.

8. A display panel, comprising a display area and a non-display area surrounding the display area; wherein, the display area comprises scan lines arranged in a second direction and each extending in a first direction, data lines arranged in the first direction and each extending in the second direction, and pixel driver circuits defined by the scan lines and the data lines intersecting with each other, the first direction intersecting the second direction;

the non-display area comprises a step area and compensation unit, and the compensation unit is located between the step area and a last row of pixel driver circuits among the pixel driver circuits;

the compensation unit comprises at least one transistor, and one electrode of the at least one transistor is connected to a corresponding data line among the data lines and configured to transmit a leakage current compensation signal to the corresponding data line;

a working process of the display panel comprises a refresh phase, the compensation unit is configured to write the leakage current compensation signal into the corresponding data line at the end of the refresh phase;

the display panel further comprising a scan driver circuit, wherein the scan driver circuit comprises cascaded scan driver circuit units, an $i_{th}$ row of scan line is connected to an $i_{th}$ stage scan driver circuit unit, a $n_{th}$ stage scan driver circuit unit is connected to a last row of scan line, an input terminal of a first stage scan driver circuit unit is connected to a first initial signal line, wherein $1 \leq i \leq n$, and i and n are positive integers; and wherein, the compensation unit comprises a compensation transistor, wherein a first electrode of the compensation transistor is connected to a compensation signal line, and a second electrode of the compensation transistor is connected to the corresponding data line; and a gate electrode of the compensation transistor is connected to an $(n+1)_{th}$ stage scan driver circuit unit a second initial signal line, wherein, the compensation unit comprises a first transistor and a second transistor, wherein a first electrode of the first transistor is electrically connected to a first power supply line, a second electrode of the first transistor is connected to a first electrode of the second transistor, and a second electrode of the second transistor is connected to the corresponding data line; and a gate electrode of the first transistor and a gate electrode of the second transistor are connected to an $(n+1)_{th}$ stage scan driver circuit unit or a second initial signal line; or the first transistor is connect to the $n_{th}$ stage scan driver circuit unit, and a gate electrode of the second transistor is connected to an $(n+1)_{th}$ stage scan driver circuit unit or a second initial signal line;

or, wherein, the compensation unit comprises a third transistor, a fourth transistor, fifth transistor and a sixth transistor;

a first electrode of the third transistor is connected to an initialization signal line, a second electrode of the third transistor is connected to a first electrode of the fourth transistor and a gate electrode of the fifth transistor, a second electrode of the fourth transistor is connected to a second electrode of the fifth transistor, a first electrode of the fifth transistor is connected to a second electrode of the sixth transistor, and a first electrode of the sixth transistor is connected to the corresponding data line; and a gate electrode of the third transistor, a gate electrode of the fourth transistor and a gate electrode of the sixth transistor are connected to an $(n+1)_{th}$ stage scan driver circuit unit or a second initial signal line, or a gate electrode of the third transistor is electrically connected to the $n_{th}$ stage scan driver circuit unit, and a gate electrode of the fourth transistor and a gate electrode of the sixth transistor are connected to an $(n+1)_{th}$ stage scan driver circuit unit or a second initial signal line, wherein an effective level of a second initial signal being located after an effective level of a $n_{th}$ scan drive signal output by the $n_{th}$ stage scan driver circuit unit.

9. The display panel of claim 8, wherein when the compensation unit comprises the first transistor and the second transistor, wherein the first electrode of the first transistor is electrically connected to the first power supply line, the second electrode of the first transistor is connected to the first electrode of the second transistor, and the second electrode of the second transistor is connected to the corresponding data line; and the compensation unit further comprises a first capacitor, and the first capacitor is electrically connected between the second electrode of the first transistor and a fixed potential signal line.

10. The display panel of claim 8, wherein when the compensation unit comprises the third transistor, the fourth transistor, the fifth transistor and the sixth transistor; the first electrode of the third transistor is connected to the initialization signal line, the second electrode of the third transistor is connected to the first electrode of the fourth transistor and the gate electrode of the fifth transistor, the second electrode of the fourth transistor is connected to the second electrode of the fifth transistor, the first electrode of the fifth transistor is connected to the second electrode of the sixth transistor, and the first electrode of the sixth transistor is connected to the corresponding data line; and the compensation unit further comprises a second capacitor, and the second capacitor is electrically connected between the second electrode of the third transistor and a fixed potential signal line.

11. A display device, comprising the display panel of claim 8.

12. A method for driving a display panel, wherein the display panel comprises a display area and a non-display area surrounding the display area, wherein, the display area comprises scan lines arranged in a second direction and each extending in a first direction, data lines arranged in the first direction and each extending in the second direction, and pixel driver circuits defined by the scan lines and the data lines intersecting with each other, the first direction intersecting the second direction, the non-display area comprises a step area and a compensation unit, and the compensation unity is located between the step area and a last row of pixel driver circuits among the pixel driver circuits, and the compensation unity comprises at least one transistor, and one electrode of the at least one transistor is connected to a corresponding data line among the data lines and configured to transmit a leakage current compensation signal to the corresponding data line;

in a case where the display panel is in a first frequency mode, a working process of the display panel comprises a refresh phase and a hold phase, wherein a drive frequency of the first frequency mode is less than or equal to 30 Hz; at the refresh phase, writing a data signal into a drive transistor, and at the end of the refresh phase, writing a current compensation signal into the corresponding data line.

13. The method of claim 12, wherein, at the end of the refresh phase, providing, by the compensation unit under control of a scan signal output by an $(n+1)_{th}$ stage scan driver circuit unit, the current compensation signal for the data line; and at the hold phase, the compensation unit not providing the current compensation signal.

14. The method of claim 12, wherein, at the end of the refresh phase, providing, by the compensation unit under control of a second initial signal, the current compensation signal for the data line; and at the hold phase, continuously providing, by the compensation unit under control of the second initial signal, the current compensation signal for the data line.

15. The method of claim 12, wherein, at the end of the refresh phase, providing, by the compensation unit under control of a second initial signal, the current compensation signal for the data line; and at each hold phase, providing, by the compensation unit under control of the second initial signal, the current compensation signal for the data line.

* * * * *